US008481252B2

(12) United States Patent
Yoshioka et al.

(10) Patent No.: US 8,481,252 B2
(45) Date of Patent: Jul. 9, 2013

(54) SILVER HALIDE PHOTOGRAPHIC PHOTOSENSITIVE MATERIAL AND PRODUCTION METHOD THEREOF

(75) Inventors: Hiroya Yoshioka, Kanagawa (JP); Hidekazu Sakai, Kanagawa (JP); Shigeru Shibayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 219 days.

(21) Appl. No.: 12/626,696

(22) Filed: Nov. 27, 2009

(65) Prior Publication Data

US 2010/0143838 A1 Jun. 10, 2010

(30) Foreign Application Priority Data

Dec. 4, 2008 (JP) ..... 2008-309755
Jun. 18, 2009 (JP) ..... 2009-145537

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |
| ***G03C 1/005*** | (2006.01) |

(52) U.S. Cl.
USPC ..... 430/502; 430/503; 430/510; 430/527; 430/543; 430/556; 430/557; 430/449; 430/631

(58) Field of Classification Search
USPC ..... 430/502–503, 510, 527, 543, 556–557, 430/631, 449
See application file for complete search history.

(56) References Cited

FOREIGN PATENT DOCUMENTS

| | | | |
|---|---|---|---|
| JP | 60041037 A | * | 3/1985 |
| JP | 02052338 A | * | 2/1990 |
| JP | 5-204084 A | | 8/1993 |
| JP | 6-148787 A | | 5/1994 |

* cited by examiner

*Primary Examiner* — Geraldina Visconti
(74) *Attorney, Agent, or Firm* — SOLARIS Intellectual Property Group, PLLC

(57) ABSTRACT

Silver halide photographic photosensitive materials are disclosed. A silver halide photographic photosensitive material has a support, and on or above the support, a red-sensitive silver halide emulsion layer, a first interlayer, a green-sensitive silver halide emulsion layer, a second interlayer, and a blue-sensitive silver halide emulsion layer in this order from the support, wherein the first interlayer includes a chelating agent and another silver halide photographic photosensitive material has, in the following order, a support, and provided on or above the support, a first interlayer containing a chelating agent, a blue-sensitive silver halide emulsion layer, a second interlayer, a red-sensitive silver halide emulsion layer, a third interlayer, a green-sensitive silver halide emulsion layer, and a protective layer.

6 Claims, No Drawings

SILVER HALIDE PHOTOGRAPHIC PHOTOSENSITIVE MATERIAL AND PRODUCTION METHOD THEREOF

CROSS-REFERENCE TO RELATED APPLICATION

This application is based on and claims priority under 35 USC 119 from Japanese Patent Application Nos. 2008-309755 filed on Dec. 4, 2008 and 2009-145537 filed on Jun. 18, 2009, the disclosures of which are incorporated herein by reference in their entireties.

FIELD OF THE INVENTION

The present invention relates to a silver halide photographic photosensitive material (hereinafter referred to as a "silver halide photosensitive material"). Specifically, the present invention relates to a silver halide photosensitive material whereby contamination is prevented from occurring due to metals mixed therein during processes of production, manufacture, storage, or photographic processing of the photosensitive material.

DESCRIPTION OF THE RELATED ART

Many attempts has been made to prevent contamination caused by metals or metal compounds that adversely affect a photosensitive material and that are mixed therein during processes of manufacture, storage, or photographic processing thereof. However, despite many such attempts, these metals contact the photosensitive material in the form of fine metal particles in the air, a metal suspension, or a metal solution, and as a result, cause stains, spots, color stains, changes in tone, or the like, which are unfavorable in an image after the photographic processing. Among these defects, generation of spot, in which a point-like image is formed by the presence of metal in an unexposed portion as if a silver halide had been exposed in the unexposed portion, spoils the appearance of an image especially in the case of digital images. As for the metals or metal oxides by which the photosensitive material is adversely affected, iron, aluminum, chromium, nickel, copper, zinc or the like are specifically exemplified. Among these metals, influence due to iron powder is greatest (hereinafter, such adverse affection due to the metals or metal oxides is referred to as a "metal defect").

For this reason, in JP-A Nos. 5-204084 and 6-148787, trials for addressing the problem of metal defects have been made by a technique whereby a chelating agent is contained in a photographic emulsion layer or a non-photographic emulsion layer. With reference to the specific Examples described in paragraph [0171] of JP-A No. 5-204084 and paragraph [0114] of JP-A No. 6-148787, a particular amino compound is contained in a low sensitivity red-sensitive silver halide emulsion layer (third layer) and a yellow filter layer (eleventh layer).

However, as a result of studies, the present inventors have found that satisfactory results are not obtained in any one of embodiments wherein the chelating agent is contained in a single layer or double layers of the low sensitivity red-sensitive photographic emulsion layer and the yellow filter layer. Specifically, when the chelating agent is contained in a yellow filter layer, the effect of suppressing the metal defects is not satisfactorily attained. Further, it has been found that when the chelating agent is contained in the low sensitivity red-sensitive silver halide emulsion layer, or in both the low sensitivity red-sensitive silver halide emulsion layer and the yellow filter layer, such a serious problem as increase in fog arises whereby fundamental properties required for the silver halide photosensitive material are deteriorated, even though the metal defects are suppressed.

As a result of further studies, the present inventors have found that satisfactory results are not obtained by introduction of a chelating agent disclosed in JP-A Nos. 5-204084 and 6-148787, depending on a layer constitution of a silver halide photosensitive material and/or the kind of a coupler used therein.

Specifically, in the case where a photosensitive material has a layer constitution having no yellow filter layer, like a print photosensitive material represented by a color positive photosensitive material for motion picture, a position of the chelating agent to be contained in the layer is largely constrained. It has been found that when the chelating agent is contained in a light-sensitive silver halide emulsion layer such as a red-sensitive silver halide emulsion layer among the layers, incorporation of the chelating agent in a quantity necessary to suppress metal defects inevitably increases fog whereby fundamental properties required for the photosensitive material are deteriorated.

Meanwhile, it has been found that such a phenomenon becomes conspicuous in a photosensitive material wherein a coupler forming a dye having a high spectral absorbance is used.

SUMMARY OF THE INVENTION

As a result of intensive studies on the above-described problems, the present inventors have found that the problems can be addressed by the following invention.

According to a first aspect of the invention, there is provided a silver halide photosensitive material having a support, and provided on or above the support, a red-sensitive silver halide emulsion layer, a first interlayer, a green-sensitive silver halide emulsion layer, a second interlayer, and a blue-sensitive silver halide emulsion layer in this order from the support, wherein the first interlayer contains a chelating agent.

According to a second aspect of the invention, there is provided a silver halide photosensitive material having in the following order, a support, and provided on or above the support, a first interlayer containing a chelating agent, a blue-sensitive silver halide emulsion layer, a second interlayer, a red-sensitive silver halide emulsion layer, a third interlayer, a green-sensitive silver halide emulsion layer, and a protective layer.

DETAILED DESCRIPTION OF THE INVENTION

First, the first aspect of the invention is mainly described in detail below.

A silver halide photosensitive material according to the first aspect of the invention can be produced by the following method.

A method of producing a silver halide photosensitive material having a long film base, and provided on or above the film base, a red-sensitive silver halide emulsion layer, a first interlayer, a green-sensitive silver halide emulsion layer, a second interlayer, and a blue-sensitive silver halide emulsion layer in this order from the support, the method including:

coating, at one time or separately divided into plural times, a coating liquid for the red-sensitive silver halide emulsion layer, a coating liquid for the first interlayer, a coating liquid for the green-sensitive silver halide emulsion layer, a coating liquid for the second interlayer, and a coating liquid for the blue-sensitive silver halide emulsion layer, setting the coating liquids and then drying the coating liquids, wherein the first interlayer contains a chelating agent.

In this specification, the term "chelating agent" means and encompasses a material capable of trapping a metal (especially iron) that causes a spot fog as the metal defect. Further, the chelating agent includes not only a multidentate ligand itself (hereinafter referred to as a "chelate ligand") that is capable of forming a metal chelate, but also a compound containing an alkali metal such as sodium or potassium as far as the compound reacts with a metal or a metal compound having a bad influence on the above-described photosensitive material to form a metal chelate containing the metal originated from the metal or metal compound. In the first and second aspects of the invention, with respect to a quality of the chelating agent, it is important that these chelating agents themselves have substantially no adverse influence on photographic properties of the photosensitive material.

The present inventors assume that during process of the production according to the first and second aspects of the invention, a chelate ligand of the chelating agent that is contained in a coating liquid for the first interlayer diffuses into the above-described coating layers after coating, and then reacts the metal or a metal compound having a bad influence on the above-described photosensitive material to form a metal chelate containing the metal originated from the metal or metal compound, whereby the metal defect (spot fog) is suppressed.

As for the chelate ligand of the chelating agent used in the first aspect of the invention, compounds represented by the below-described formula (I) are preferable. Among these compounds, EDTA (ethylenediaminetetraacetic acid) or NTA (nitrilotriacetic acid) is especially preferable from the viewpoints of easy availability and effects. Further, from the viewpoints that the metal defect is suppressed to a satisfactory level while keeping photographic properties such as fog at the level equal to those obtained without addition of the chelating agent, it is preferable to contain the chelating agent in such amount that the content of the chelating agent in the silver halide photosensitive material is in the range of $1.0\times10^{-8}$ mol/m$^2$ to $2.0^{-3}\times$mol/m$^2$. Meanwhile, it is preferable that the content of the chelating agent in the silver halide photosensitive material is from 0.0001 g/m$^2$ to 0.6 g/m$^2$.

By the silver halide photosensitive material according to the first aspect of the invention, it is possible to suppress a defect due to mixing of metals such as iron powder to a satisfactory level without deteriorating fundamental photographic properties. Further, by the production method according to the first aspect of the invention, it is possible to obtain the silver halide photosensitive material having the above-described properties.

In the below-described explanation of the invention, the "red-sensitive silver halide emulsion layer", the "green-sensitive silver halide emulsion layer", and the "blue-sensitive silver halide emulsion layer" are also each referred to as "unit light-sensitive layer". It is preferable that the unit light-sensitive layer is composed of at least two layers, more preferably three layers, having different sensitivity from each other, from the viewpoint that excellent reproducibility can be ensured even though an object is photographed under the environment of broad range having a difference in luminance. Further, at least one protective layer may be disposed on or above the blue-sensitive silver halide emulsion layer, and a undercoating layer may be disposed between the support and the red-sensitive silver halide emulsion layer. Further, antihalation layer may be disposed on the surface (back surface) of the support opposite to the emulsion layer. Further, the second interlayer may be a yellow filter layer. In this case, the second interlayer may be provided with a yellow filter function by incorporating silver halide grains therein.

In the silver halide photosensitive material according to the first aspect of the invention, the disposition of unit light-sensitive layers is a set of a red-sensitive silver halide emulsion layer, a green-sensitive silver halide emulsion layer, and a blue-sensitive silver halide emulsion layer in this order from the support. Further, inter layers are disposed between these unit light-sensitive layers, and an upper most layer (protective layer) may be disposed on or above the blue-sensitive silver halide emulsion layer. Further, a lowermost layer such as an undercoating layer may be disposed between the red-sensitive silver halide emulsion layer and the support. Ordinarily, a first interlayer, an upper most layer and a lowermost layer are each light-insensitive. In these layers, the below-described couplers, DIR compounds, color mixing-preventing agents may be contained. When each unit light-sensitive layer is composed of two or more silver halide emulsion layers, it is preferable to arrange these emulsion layers so that sensitivities sequentially decline toward the support.

In the silver halide photosensitive material according to the first aspect of the invention, the first interlayer contains a chelating agent.

As for the chelating agent, any chelating compound may be used, as far as the compound forms a metal chelate with a metal or a metal oxide each having a bad influence on the photosensitive material. Especially, a compound that forms a metal chelate with iron is preferable. Further, during production of the photosensitive material, the chelating agent may migrate from a first interlayer to a red-sensitive silver halide emulsion layer and/or a green-sensitive silver halide emulsion layer. In this case, it is thought that the chelating agent may trap silver ions in these layers adjacent to the first interlayer. For this reason, it is preferable that a chelating agent has higher stability constant with iron ions than that with silver ions. The use of such chelating agent enables to suppress bad influence on photographic properties. Preferable examples of such the chelating agent include a compound represented by the following Formula (I):

Formula (I)

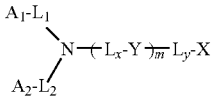

Wherein, in Formula (I), $L_x$ and $L_y$ each independently represent an alkylene group or a substituted alkylene group; Y represents —O—, or a group represented by the following Formula (II):

Formula (II)

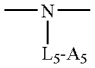

m represents an integer of 0 or 1; X represents a carboxyl group or an alkali metal salt thereof, a phosphono group or an alkali metal salt thereof, a sulfo group or an alkali metal salt thereof, a hydroxyl group or a group represented by the following Formula (III):

Formula (III)

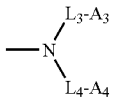

$A_1$, $A_2$, $A_3$, $A_4$ and $A_5$ each independently represent a carboxyl group or an alkali metal salt thereof, a phosphono group or an alkali metal salt thereof, a sulfo group or an alkali metal salt thereof, or a hydroxyl group; and $L_1$, $L_2$, $L_3$, $L_4$ and $L_5$ each independently represent an alkylene group.

The alkylene group means a divalent group of alkane excluding two hydrogen atoms therefrom, and has preferably from 1 to 10 carbon atoms, and more preferably from 2 to 3 carbon atoms. Specific examples of the alkylene group include a 1,2-ethylene group, or a trimethylene group.

Further, $A_1$, $A_2$, $A_3$, $A_4$ and $A_5$ are preferably a carboxyl group. Specific examples of the chelate ligand used in the invention are described below.

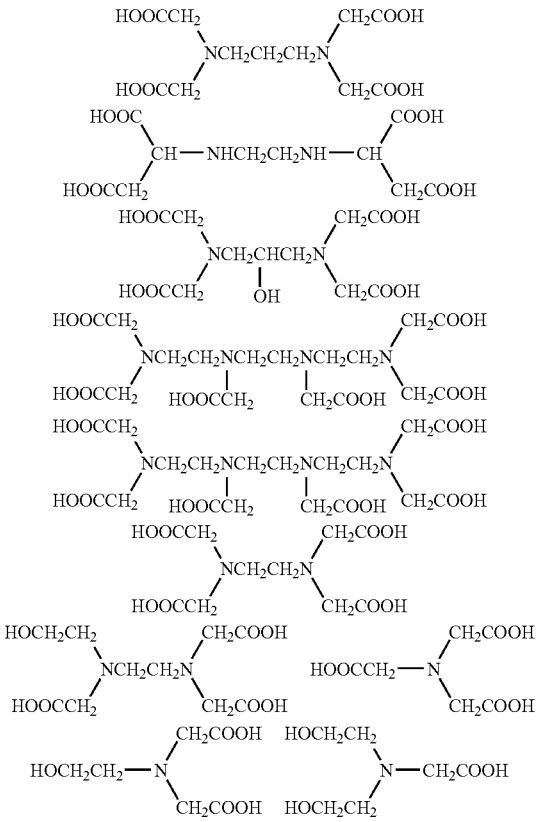

In the first aspect the invention, compounds in which some part or all of carboxyl groups in these ligands form a sodium salt or a potassium salt may be also used as a chelating agent. In the invention, EDTA.2Na and NTA.3Na are each especially preferable from the viewpoints that they are available at low cost, and have a sufficient capacity to suppress generation of the metal defect without deteriorating photographic properties, and further they may be added in a form of an aqueous solution into a coating liquid for the first interlayer during production of the photosensitive material.

The chelating agent may be used singly or in combination of two or more species. The content of the chelating agent in the photosensitive material is an amount necessary to suppress generation of the metal defect and preferably from $1.0\times10^{-8}$ mol/m$^2$ to $2.0\times10^{-3}$ mol/m$^2$. The upper limit of the amount is preferably $1.5\times10^{-3}$ mol/m$^2$, more preferably $8.0\times10^{-4}$ mol/m$^2$, and especially preferably $4.0\times10^{-5}$ mol/m$^2$. The lower limit of the amount is more preferably $1.0\times10^{-6}$ mol/m$^2$, and further preferably $3.0\times10^{-6}$ mol/m$^2$.

Meanwhile, the content of the chelating agent in the photosensitive material is preferably from 0.0001 g/m$^2$ to 0.6 g/m$^2$, more preferably from 0.0006 g/m$^2$ to 0.1 g/m$^2$, and most preferably from 0.001 g/m$^2$ to 0.02 g/m$^2$. If the amount of the chelating agent is in the above-described range, the metal defect can be suppressed, and there is no substantial possibility that fundamental photographic properties are deteriorated. The chelating agent that is used in a coating liquid for the first interlayer during production of the photosensitive material is added to the coating liquid so as to be the above-described contents.

A silver halide emulsion (hereinafter also referred to as an "emulsion of the invention") that may be used in the silver halide photosensitive material according to the first aspect of the invention is preferably a silver iodobromide, silver bromide, silver chloroiodobromide tabular emulsion.

In the silver halide photosensitive material according to the first aspect of the invention, it is preferable that each unit light-sensitive layer is composed of two or more silver halide emulsion layers each having substantially same color sensitivity, but different photographic sensitivity (speed) from each other, and 50% or more of the total projected areas of silver halide grains contained in at least one layer of emulsion layers having relatively higher photographic sensitivity than another emulsion layer among silver halide emulsion layers that compose the each unit light-sensitive layer is tabular silver halide grains (hereinafter also referred to as "tabular grains"). In the invention, an average aspect ratio of the tabular grains is preferably equal to 8 or more than 8, more preferably equal to 12 or more than 12, and most preferably equal to 15 or more than 15.

With respect to the tabular grains, the aspect ratio means a ratio of a diameter of silver halide grain to a thickness thereof. In other words, the aspect ratio is a value of a diameter of silver halide grain divided by a thickness thereof. Herein, the diameter is defined as a diameter of the circle having an area equal to a projected area of silver halide grain, when the silver halide grain is observed using a microscope or an electron microscope. Further in this specification, the average aspect ratio is defined as a mean value of total aspect ratios of tabular grains in the emulsion.

With respect to the silver halide photographic emulsion used in a highest sensitivity layer of each of the red-sensitive silver halide emulsion layer and the green-sensitive silver halide emulsion layer according to the first aspect of the invention, it is preferable that 50% or more of the total silver halide grains in the photographic emulsion each have a grain thickness of 0.15 μm or less. It is more preferable that 60% or more of the total silver halide grains in the photographic emulsion each have a grain thickness of 0.15 μm or less. Further, it is also preferable that 50% or more of the total silver halide grains in the photographic emulsion each have a grain thickness of 0.01 μm to 0.15 μm.

Measurements of the aspect ratio and the grain thickness were performed by photographing grains using a transmission electron microscope according to a replica method, and measuring a circle-equivalent diameter and thickness of each grain. In this measurement, the thickness is calculated from a shadow length of the replica.

The tabular grain emulsion preferably contains silver iodobromide, or silver chloroiodobromide as a component. The tabular grain emulsion may contain silver chloride with a content thereof being preferably 8 mol % or less, more preferably 3 mol % or less, and most preferably 0 mol %. Since the variation coefficient of grain size distribution of the tabular grain emulsion is preferably 30% or less, the content of silver iodide is preferably 20% or less. The variation coefficient of circle-equivalent diameter distribution of the tabular grain emulsion can be easily reduced by making the content of silver iodide small. Especially, the variation coefficient of grain size distribution of the tabular grain emulsion is preferably 20% or less and the content of silver iodide is preferably 10% or less.

The silver halide emulsion used in the first aspect of the invention is preferably subjected to selenium sensitization or gold sensitization.

acting on tiny silver grains that are formed as a by-product in the course of forming silver halide grains and the course of chemically sensitizing the silver halide grains, and converting them to a silver ion.

The silver halide emulsion used in the first aspect of the invention may be provided with a desirable color sensitivity by spectral sensitization preferably using methine dyes or the like. Further, it is possible to use an ordinary dopant that is known as a useful material for a silver halide emulsion.

In the silver halide photosensitive material according to the first aspect of the invention, various kinds of additives other than the additives described above may be used in accordance with their purposes. General explanations of these additives are described in Research Disclosure Item 17643 (December 1978), ditto Item 18716 (November 1979) and ditto Item 308119 (December 1989). Pertinent portions thereof are shown together in the following table.

| Kind of Additive | RD 17643 | RD 18716 | RD 308119 |
|---|---|---|---|
| 1. Chemical Sensitizer | P. 23 | P. 648 Right Col. | P. 996 |
| 2. Sensitivity increasing Agent | " | " | " |
| 3. Spectral Sensitizer & Supersensitizer | PP. 23-24 | P. 648 Right Col.-P. 649 Right Col. | P. 996 Right Col.-P. 998 Right Col |
| 4. Whitening Agent | P. 24 | | P. 998 Right Col |
| 5. Antifoggant & Stabilizer | PP. 24-25 | P. 649 Right Col. | P. 998 Right Col-P.1000 Right Col |
| 6. Light Absorbent Filter Dye & UV Absorbent | PP. 25-26 | P. 649 Right Col.-P. 650 Right Col. | P.1003 Left Col.-P.1003 Right Col. |
| 7. Anti-stain Agent | P. 25 Right Col. | P. 650 Left Col.-P. 650 Right Col. | P.1002 Right Col. |
| 8. Dye image Stabilizer | P. 25 | | P.1002 Right Col. |
| 9. Hardener | P. 26 | P. 651 Left Col. | P.1004 Right Col.-P.1005 Left Col. |
| 10. Binder | P. 26 | " | P.1003 Right Col.-P.1004 Right Col. |
| 11. Plasticizer & Lubricant | P. 27 | P. 650 Right Col. | P.1006 Left Col.-P.1006 Right Col. |
| 12. Coating Aid & Surfactant | PP. 26-27 | " | P.1005 Left Col.-P.1006 Left Col. |
| 13. Anti-static Agent | P. 27 | " | P.1006 Right Col.-P.1007 Left Col. |
| 14. Matt Agent | | | P.1008 Left Col.-P.1009 Left Col. |

As for the selenium sensitizer that can be used in the first aspect of the invention, selenium compounds disclosed by known patent publications may be used.

It is desirable that sulfur sensitization is conducted together with other sensitizers in chemical sensitization of the silver halide emulsion used in the first aspect of the invention. The silver halide emulsion used in the invention may be reduction-sensitized during or after grain formation, and before, during, or after chemical sensitization.

As for the reduction sensitization, any method may be selected from a method of adding a reduction sensitizer to a silver halide emulsion; a method of glowing or ripening silver halide grains in a low pAg atmosphere of pAg 1 to 7 (this method is called silver ripening), or a method of glowing or ripening silver halide grains in a high pH atmosphere of pH 8 to 11 (this method is called high pH ripening). Further, two or more methods described above may be used together.

It is preferable that an oxidant for silver is used during production of the silver halide emulsion used in the first aspect of the invention. The oxidant for silver means a compound capable of acting on a metal silver to convert it a silver ion. Especially useful oxidants are compounds capable of Details of techniques such as layer arrangement, silver halide emulsions, dye-forming couplers, functional couplers such as DIR couplers, and various kinds of additives that are used in the silver halide photosensitive material according to the first aspect of the invention and a development processing of the silver halide photosensitive material according to the first aspect of the invention are described in European Patent No. 0565096A1 (publication date: Oct. 13, 1993) and patent publications referred therein, which may be applied to the first aspect of the invention. Below, each item and the relevant portion corresponding to the item are listed.

1. Layer Constitution: P 61 L 23-35, P61 L 41-P 62 L 14
2. Interlayer: P 61 L 36-40
3. Interlayer Effect-imparting Layer: P 62 L 15-18
4. Halogen Composition of Silver halide: P 62 L 21-25
5. Crystal Habit of Silver halide grain: P 62 L 26-30
6. Grain Size of Silver halide: P 62 L 31-34
7. Production Method of Emulsion: P 62 L 35-40
8. Size Distribution of Silver halide grains: P 62 L 41-42
9. Tabular grain: P 62 L 43-46
10. Internal Structure of grain: P 62 L 47-53
11. Latent Image-forming Type of Emulsion: P 62 L 54-P 63 L5

12. Physical Ripening and Chemical Ripening of Emulsion: P 63 L 6-P 63 L9
13. Use of Mixed Emulsion: P 63 L 10-13
14. Fogged Emulsion: P 63 L 14-31
15. Light-insensitive Emulsion: P. 63 L 32-43
16. Coated Silver Amount: P. 63 L 49-50
17. Formaldehyde Scavenger: P. 64 L 54-57
18. Mercapto-based Antifoggant: P. 65 L1-2
19. Fogging Agent or the like-releasing Agent: P. 65 L 3-7
20. Dye: P. 65 L 7-10
21. General Color Couplers: P. 65 L 11-13
22. Yellow, Magenta and Cyan Couplers: P. 65 L 14-25
23. Polymer Coupler: P. 65 L 26-28
24. Diffusible dye-forming Coupler: P. 65 L 29-31
25. Colored Coupler: P. 65 L 32-38
26. General Functional Couplers: P. 65 L 39-44
27. Bleach accelerator-releasing Coupler: P. 65 L 45-48
28. Development accelerator-releasing Coupler: P. 65 L 49-53
29. DIR Coupler and others: P. 65 L 54-P. 66 L 4
30. Coupler Dispersion Method: P. 66 L 5-28
31. Antiseptic agent and Fungicide: P. 66 L 29-33
32. Types of Light-sensitive Material: P. 66 L 34-36
33. Coating Thickness of Light-sensitive Layer and Swelling Speed: P 66 L 40-P 67 L1
34. Back Layer: P. 67 L 3-8
35. General development processing: P. 67 L 9-11
36. Developing solution and developing agent: P. 67 L 12-30
37. Additives to developing solution: P. 67 L 31-44
38. Reversal processing: P. 67 L 45-56
39. Processing solution aperture ratio: P 67 L 57-P 68 L12
40. Developing time: P. 68 L 13-15
41. Bleach-fix, bleach, fix: P 68 L 16-P 69 L31
42. Auto processor: P. 69 L32-40
43. Washing, rinse, stabilization: P 69 L 41-P 70 L18
44. Replenishment and reuse of processing solution: P. 70 L19-23
45. Developer-incorporated light-sensitive material: P. 70 L24-33
46. Developing temperature: P. 70 L 34-38

A proper support that can be used in the first aspect of the invention is described in, for example, page 28 of the above-described R D Item 17643; page 647, right column to left column of R D Item 18716; and page 879 of R D Item 307105.

In the photosensitive material according to the first aspect of the invention, it is preferable to dispose a back layer having a total dried film thickness of 0.5 μm to 20 μm at the side of the support opposite to the side of the support having thereon an emulsion layer. It is preferable that this back layer contains, for example, the above-described light absorber, carbon black, a filter dye, an ultraviolet absorbent, an antistatic agent, a hardener, a binder, a plasticizer, a lubricant, a coating aid, or a surfactant. Among these materials, carbon black or an antistatic agent is especially preferable.

The photosensitive material according to the first aspect of the invention may be advantageously used for any of amateur's color negative films, advanced amateur's color negative films, professional-quality color negative films, and color negative films for motion picture. Use of the color negative films for motion picture is most preferable. In the color negative films for motion picture, a demand for quality is severe whereby acceptable range of spot fog is narrow. It is possible to minimize the spot fog according to the invention, and therefore the invention may provide a great effect particularly in the color negative films for motion picture.

The silver halide photosensitive material according to the first aspect of the invention may be produced by coating at one time a coating liquid for the red-sensitive silver halide emulsion layer, a coating liquid for the first interlayer, a coating liquid for the green-sensitive silver halide emulsion layer, a coating liquid for the second interlayer, and a coating liquid for the blue-sensitive silver halide emulsion layer on or above a long base provided with a undercoat layer if needed, according to a simultaneous multilayer coating method, and then setting and drying the coated layers. In this occasion, it is inevitable in a production environment that a fine iron powder or the like is caught up in air and adheres to the surface of the base (support) just before the above-described coating liquids are coated thereon. However, by incorporating a chelating agent in the coating liquid for the first interlayer, a reaction between the iron powder and light-sensitive silver halide grains in the photographic emulsion are suppressed, whereby the metal defect can be prohibited effectively.

In contrast, when the chelating agent is incorporated in a coating liquid for the red-sensitive silver halide emulsion layer, the chelating agent reacts with light-sensitive silver halide grains in the photographic emulsion, thereby causing deterioration of photographic properties such as increase in fogging. Beside, when the chelating agent is incorporated in a coating liquid for the second interlayer (ordinarily a yellow filter layer) that is arranged at a further position from the base, it takes a time until an iron powder contaminating the surface of the base reacts with the chelating agent to produce an iron chelate. As a result, during the period of time when the iron chelate is produced, the iron powder gets to react with light-sensitive silver halide grains (for example, silver halide grains in a coating liquid for the red-sensitive silver halide emulsion layer), which results in occurrence of spot fog. Therefore, it is very important to incorporate a chelating agent in a first interlayer.

Alternatively, when a coating liquid for the red-sensitive silver halide emulsion layer, a coating liquid for the first interlayer, a coating liquid for the green-sensitive silver halide emulsion layer, a coating liquid for the second interlayer, and a coating liquid for the blue-sensitive silver halide emulsion layer are coated at two times on or above a long base provided with a undercoat layer if needed, according to a simultaneous multilayer coating method, for example, at the first coating step, a coating liquid for the red-sensitive silver halide emulsion layer and a coating liquid for the first interlayer are simultaneously coated on the base, and then set and dried, and then at the second coating step, on these layers, a coating liquid for the green-sensitive silver halide emulsion layer, a coating liquid for the second interlayer, and a coating liquid for the blue-sensitive silver halide emulsion layer are simultaneously coated, and then set and dried, thereby producing a finished silver halide photosensitive material, it is preferable to incorporate a chelating agent also in the second interlayer in addition to the first interlayer. This is because, with respect to the iron powder having contaminated the surface of the base, the chelating agent incorporated in the first interlayer forms an iron chelate, and in contrast, with respect to the iron powder having contaminated the surface of the coating layer (for example, in this case, the surface of the first interlayer), the chelating agent incorporated in the second interlayer effectively functions.

A developing solution used for developing the silver halide photosensitive material according to the first aspect of the invention is preferably an aqueous alkaline solution containing, as a main ingredient, a primary amine color developing agent. Generally, the color developing solution contains for examples a pH buffering agent such as alkali metal carbonates, a borate salt, or a phosphate salt, and a development-inhibiting agent, or antifogging agent such as a chloride salt, a bromide salt, a iodide salt, benzimidazoles, benzothiazoles, or mercapto compounds. The time required for the color developing processing is ordinarily set within the period of 2 to 5 minutes. However, it is possible to further shorten a processing time by changing the developing conditions to a high temperature and high pH and also by using a high concentration of the color developing agent.

After color development, photographic emulsion layers are usually subjected to a bleach processing. The bleach processing may be performed simultaneously with a fixing processing (bleach-fixing processing) or may be performed independently from a fixing processing. Further, for the purpose of rapid processing, a processing method in which a bleach-fixing processing is carried out after a bleaching processing may be used. Moreover, it may be appropriate depending on the intended use to perform a bleach-fixing processing with two continuous bleach-fixing baths, to perform a fixing processing before a bleach-fixing processing, or to perform a bleaching processing after a bleach-fixing processing.

It is preferable that the total time required for desilverization is short so long as the time is within a range in which defects of silver removal is not caused. Preferably, the period of time for desilverization is 1 to 3 minutes and more preferably from 1 to 2 minutes. The temperature at which the desilverization is performed is 25° C. to 50° C., preferably 35° C. to 45° C. After the desilverization step, the silver halide photosensitive material of the invention is generally subjected to a water-washing step and/or a stabilizing step. The amount required for the water-washing step may be determined over a wide range depending on the characteristics of the photosensitive material (for example, employed materials such as couplers), the intended use thereof, and further temperature of the washing water, the number of washing tank (number of stages), the replenishing system such as counter-current or direct flow current, or other various conditions.

The pH of the washing water used for processing the silver halide photosensitive material according to the first aspect of the invention is generally from 4 to 9, and preferably from 5 to 8. The temperature of the washing water and the washing time may be set in accordance with the characteristics of the photosensitive material and the intended use thereof. In general, the setting range may be from 20 seconds to 10 minutes at 15° C. to 45° C., and preferably from 30 seconds to 5 minutes at 25° C. to 40° C. Further, the silver halide photosensitive material according to the first aspect of the invention may be directly processed with a stabilizing solution instead of washing water.

After the water washing process, a stabilizing process may be performed. As an example, a stabilizing bath containing a dye stabilizer and a surfactant may be used as a final stage bath for processing the color photosensitive material for shooting.

The overflow solution resulting from replenishment of the above-described washing water and/or stabilizing solution may be reused in other steps such as a desilverization step. In the processing with an automatic processor, when the processing solutions become concentrated due to evaporation, it is preferable to correct the concentration by adding water thereto.

Next, the second aspect of the invention is described in detail below.

As for the chelate ligand of the chelating agent used in the second aspect of the invention, compounds represented by the above-described Formula (I) are preferable. Among these compounds, EDTA or NTA is especially preferable from the viewpoints of easy availability and effects. Further, from the viewpoints that the metal defect is suppressed to a satisfactory level while keeping photographic properties such as fog at the level equal to those obtained without addition of the chelating agent, it is preferable to contain the chelating agent in such amount that the content of the chelating agent in the silver halide photosensitive material is within the range of $2.0\times10^{-4}$ mol/m$^2$ to $2.0\times10^{-3}$ mol/m$^2$.

By the silver halide photosensitive material according to the second aspect of the invention, it is possible to suppress metal defects to a satisfactory level without deteriorating fundamental photographic properties.

The silver halide photosensitive material according to the second aspect of the invention has, as a basic constitution, in the following order, a support, and provided on or above the support, a first interlayer, a blue-sensitive silver halide emulsion layer, a second interlayer, a red-sensitive silver halide emulsion layer, a third interlayer, a green-sensitive silver halide emulsion layer, and a protective layer, the first interlayer containing a chelating agent.

In the below-described explanation of the invention, the "blue-sensitive silver halide emulsion layer", the "red-sensitive silver halide emulsion layer" and the "green-sensitive silver halide emulsion layer" are also each referred to as "unit light-sensitive layer". The unit light-sensitive layer may be composed of one layer, or alternatively two or three layers. In the case where the unit light-sensitive layer is composed of two or more layers, the composition of these layers may be the same or different from each other. For example, these layers may be composed of emulsions having different sensitivities (speeds) from each other. Further, the protective layer may be composed of one layer, or alternatively two or three layers. In the case where the protective layer is composed of two layers, the composition of these layers may be the same or different from each other. For example, quantities of additives in these layers may be different from each other. Still further, each of the first interlayer, the second interlayer and the third interlayer may be composed of one layer, or alternatively two or three layers. In particular, it is preferable from a viewpoint of obtaining excellent photographic properties that the first interlayer is composed of a lower layer and an antihalation layer, the lower layer being nearer to the support than the antihalation layer.

Ordinarily, the first interlayer, the second interlayer, the third interlayer and the protective layer are each light-insensitive. At least one of these layers may contain the below-described color mixing-preventing agent, dyes, or the like.

In the silver halide photosensitive material according to the second aspect of the invention, the first interlayer contains a chelating agent. The reason why the metal defects are effectively suppressed by a chelating agent that is contained in the first interlayer is presumed as follows. This silver halide photosensitive material has, as a basic constitution, in the following order, a support, and provided on or above the support, a first interlayer, a blue-sensitive silver halide emulsion layer, a second interlayer, a red-sensitive silver halide emulsion layer, a third interlayer, a green-sensitive silver halide emulsion layer, and a protective layer. Among these layers, a mean grain size of silver halide grains contained in the blue-sensitive silver halide emulsion layer is relatively larger than those of the red-sensitive silver halide emulsion layer and the green-sensitive silver halide emulsion layer. Therefore, the metal defect is most likely to occur in the blue-sensitive silver halide emulsion layer. Accordingly, by previously incorporating a chelating agent in the first interlayer near the blue-sensitive silver halide emulsion layer, the chelating agent traps iron powder before the iron powder interacts with silver halide grains in the blue-sensitive silver halide emulsion layer. As a result, it is presumed that an interaction between the iron powder and the silver halide grains is suppressed.

As for the chelating agent, any chelating compound may be used, as far as the compound forms a metal chelate with a metal or a metal oxide each having a bad influence on the photosensitive material. Especially, a compound that forms a metal chelate with iron is preferable. Further, during production of the photosensitive material, the chelating agent may migrate from a first interlayer to adjacent layers such as a blue-sensitive silver halide emulsion layer and a red-sensitive silver halide emulsion layer. In this case, it is thought that the chelating agent may trap silver ions in these layers adjacent to the first interlayer. For this reason, it is preferable that a chelating agent has higher stability constant with iron ions than that with silver ions. The use of such chelating agent enables to suppress bad influence on photographic properties. Preferable examples of such the chelating agent include a compound represented by the Formula (I) described in the first aspect of the invention.

Specific examples of a chlate ligand used in the second aspect of the invention are the same as those listed in the first aspect of the invention.

In the second aspect the invention, compounds in which some part or all of carboxyl groups in these ligands form a sodium salt or a potassium salt may be also used as a chelating agent. In the invention, EDTA.2Na and NTA.3Na are each especially preferable from the viewpoints that they are available at low cost, and have a sufficient capacity to suppress generation of the metal defect without deteriorating photographic properties, and further they may be added in a form of an aqueous solution into a coating liquid for the first interlayer during production of the photosensitive material.

The chelating agent may be used singly or in combination of two or more species. The content of the chelating agent in the photosensitive material is not particularly limited, as far as the amount is sufficient to suppress generation of the metal defect. However, the content is preferably from $1.0\times10^{-5}$ mol/m$^2$ to $1.0\times10^{-2}$ mol/m$^2$. The upper limit of the amount is preferably $5.0\times10^{-3}$ mol/m$^2$, more preferably $2.0\times10^{-3}$ mol/m$^2$, and especially preferably $1.0\times10^{-3}$ mol/m$^2$. The lower limit of the amount is more preferably $5.0\times10^{-5}$ mol/m$^2$, further preferably $2.0\times10^{-4}$ mol/m$^2$, and still further preferably $3.0\times10^{-4}$ mol/m$^2$.

Examples of silver halide grains in a silver halide emulsion that can be used in the silver halide photosensitive material according to the second aspect of the invention include silver chloride, silver bromide, silver (iodo) chlorobromide, silver iodobromide and the like. Silver halide grains may have a regular crystal system such as cube, octahedron, or tetradecahedron, irregular crystal system such as spherical or tabular shape, or crystal defects such as twin plane, or composite systems thereof.

As for the silver halide emulsion that can be more preferably used in the second aspect of the invention, silver chloro (iodide), or silver chloro(iodo)bromide having a chloride content of 95% by mole or more is preferable, and a silver halide emulsion having a chloride content of 98% by mole or more is further preferable from the viewpoint of rapid processing properties. In particular, it is a preferable embodiment that these high chloride silver halide emulsions are contained in the blue-sensitive silver halide emulsion layer.

With reference to a grain size, fine grains having a grain size of about 0.2 μm or less may be used, or large grains of up to about 10 μm in terms of a projected area diameter may be used. However, for a color positive photosensitive material for motion picture, the size range of 0.10 μm to 0.70 μm is preferably used. Silver halide emulsion grains may be multi-dispersed or mono-dispersed. In order to accelerate a progress of development, a mono-dispersed emulsion is preferable. A variation coefficient of grain size of respective silver halide grains is preferably 0.25 or less (more preferably 0.05 to 0.25), and more preferably 0.20 or less (more preferably 0.05 to 0.20). The term "variation coefficient" herein used is expressed by the ratio (s/d) of the standard deviation (s) on statistics to the mean grain size (d).

The silver halide photographic emulsion used in the second aspect of the invention can be prepared according to a method described, for example, in Research Disclosure (hereinafter, abbreviated as RD) Item 17643 (December 1978), pages 22 to 23, "I. Emulsion preparation and types", ditto Item 18716 (November 1979), page 648, ditto Item 307105 (November 1989), pages 863 to 865, P. Glafkides, Chemie et Phisique Photographique, Paul Montel, 1967, G. F. Duffin, Photographic Emulsion Chemistry, Focal Press, 1966, and V. L. i, et al., Making and Coating Photographic Emulsion, Focal Press, 1964.

The crystal structure may be either uniform or different in halogen composition between its interior and exterior, or a layered structure may be used. Further, two or more kinds of silver halides having a different composition from each other may be joined with each other by epitaxial junction. Alternatively, the silver halide may be joined to a compound other than silver halide, such as rhodan silver, or lead oxide. Further, a mixture of silver halides having various crystal shapes may be also used.

The aforementioned emulsion may be a surface latent image type emulsion where a latent image is formed predominantly on the surface of silver halide grain, or an internal latent image type emulsion where a latent image is formed predominantly inside the silver halide grain, or such a type emulsion where a latent image is formed in both the surface and the interior. However, these emulsions must be negative. As the internal latent image type emulsion, a core/shell internal latent image type emulsion described in JP-A No. 63-264740 may be used, and a preparation method thereof is described in JP-A No. 59-133542. The thickness of the shell of the emulsion is preferably from 3 to 40 nm, and particularly preferably from 5 to 20 nm, while it varies depending on the conditions of development processing or the like.

The silver halide emulsion is ordinarily subjected to a physical ripening, a chemical ripening, and a spectral sensitization before use. Additives used in these processes are described in RD Item 17643, ditto Item 18716 and ditto Item 308119. Pertinent portions thereof are shown together in the above-described table.

In the silver halide photographic emulsion used in the second aspect of the invention, two or more kinds of emulsions, which are different in at least one of properties of the photosensitive silver halide emulsion, i.e., in terms of at least one of grain size, grain size distribution, halogen composition, shape of grain, and sensitivity may be used as a mixture in the same layer.

A coating amount of silver in terms of silver-reduced quantity of all the silver halide emulsion layers in the silver halide color photosensitive material according to the second aspect of the invention is preferably 3.0 g/m$^2$ or less, more preferably 2.5 g/m$^2$ or less, and further preferably 2.0 g/m$^2$ or less. Meanwhile, the coating amount of silver used therein is generally 0.5 g/m$^2$ or more, preferably 0.7 g/m$^2$ or more, and more preferably 1.0 g/m$^2$ or more.

Various kinds of dye-forming couplers may be used in the silver halide color photosensitive material according to the second aspect of the invention. Among these couplers, the following dye-forming couplers are especially preferable.

Yellow coupler: couplers represented by Formula (I) or (II) described in European Patent EP 502,424A; couplers represented by Formula (1) or (2) described in European Patent EP 513,496A (especially Y-28 on page 18); couplers represented by Formula (I) described in claim 1 of JP-A-No. 5-307248; couplers represented by Formula (I) described in column 1, lines 45 to 55 of U.S. Pat. No. 5,066,576; couplers represented by Formula (I) described in paragraph 0008 of JP-A-No. 4-274425; couplers described in claim 1 on page 40 of European Patent EP 498,381A1 (especially D-35 on page 18); couplers represented by Formula (Y) described on page 4 of European Patent EP 447,969A1 (especially Y-1 (page 17), Y-54 (page 41)); and couplers represented by Formulae (II) to (IV) described in column 7, lines 36 to 58 of U.S. Pat. No. 4,476,219 (especially II-17, 19 (column 17), II-24 (column 19)).

Magenta coupler: JP-A-No. 3-39737 (L-57 (page 11, right lower column), L-68 (page 12, right lower column), L-77 (page 13, right lower column); A-4-63 (page 134), and A-4-73, A-4-75 (page 139) of European Patent EP 456,257; M-4 and M-6(page 26), and M-7 (page 27) of European Patent EP486,965; M-45 described in paragraph 0024 of JP-A-No. 6-43611; M-1 described in paragraph 0036 of JP-A-No. 5-204106; and M-22 described in paragraph 0237 of JP-A-No. 4-362631.

Cyan coupler: CX-1, -3, -4, -5, -11, -12, -14, and -15 (pages 14 to 16) of JP-A-No. 4-204843; C-7 and C-10 (page 35), C-34 and C-35 (page 37), and (I-1) and (I-17) (pages 42 to 43) of JP-A-No. 4-43345; and couplers represented by Formula (Ia) or (Ib) described in claim 1 of JP-A-No. 6-67385.

Polymer coupler: P-1 and P-5 (page 11) of JP-A-No. 2-4345.

As for the coupler capable of forming a properly diffusible dye, those described in U.S. Pat. No. 4,366,237, British Patent GB 2,125,570, European Patent EP 96,873B, and German Patent DE3,234,533 are preferable. The coupler used for correcting unnecessary absorption of the developed dye is preferably yellow colored cyan couplers represented by Formula (C-I), (C-II), (C-III), or (C-IV) described on page 5 of European Patent EP456,257 A1 (especially YC-86 on page 84), yellow colored magenta couplers ExM-7 (page 202), EX-1 (page 249) and EX-7 (page 251) described in European Patent EP456,257 A1, magenta colored cyan couplers CC-9 (column 8) and CC-13 (column 10) described in U.S. Pat. No. 4,833,069, Coupler (2) (column 8) described in U.S. Pat. No. 4,837,136, and colorless masking couplers represented by Formula [C-1] described in claim 1 of International Publication WO 92/11575 (exemplified compounds on pages 36 to 45 in particular).

It is preferable that at least one yellow dye-forming coupler represented by the following Formula (IV) is contained in a blue-sensitive silver halide emulsion layer of the silver halide photosensitive material according to the second aspect of the invention.

Formula (IV)

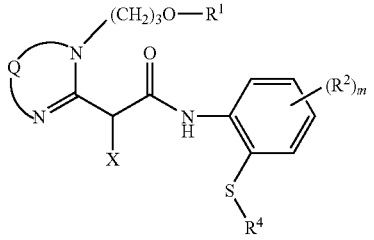

In Formula (IV), $R^1$ represents a substituted or unsubstituted alkyl group having 4 to 8 carbon atoms. Examples of the substituent which $R^1$ may have include a halogen atom; an alkyl group including a cycloalkyl group and a bicycloalkyl group; an alkenyl group including a cycloalkenyl group and a bicycloalkenyl group; an alkynyl group; an aryl group; a heterocyclic group; a cyano group; a hydroxyl group; a nitro group; a carboxyl group; an alkoxy group; an aryloxy group; a silyloxy group; a heterocyclic oxy group; an acyloxy group; a carbamoyloxy group; an alkoxycarbonyloxy group; an aryloxycarbonyloxy group; an amino group including an alkylamino group and an anilino group; an acylamino group, an aminocarbonylamino group; an alkoxycarbonylamino group; an aryloxycarbonylamino group; a sulfamoylamino group; an alkyl or arylsulfonylamino group; a mercapto group; an alkylthio group; an arylthio group; a heterocyclic thio group; a sulfamoyl group; a sulfo group; an alkyl or arylsulfinyl group; an alkyl or arylsulfonyl group; an acyl group; an aryloxycarbonyl group; an alkoxycarbonyl group; a carbamoyl group; an aryl or heterocyclic azo group; an imido group; a phosphino group; a phosphinyl group; a phosphinyloxy group; a phosphinylamino group; and a silyl group.

Meanwhile, the above-described substituent may be further substituted with a substituent. Examples of the substituent include the same as those listed above.

$R^1$ is preferably an unsubstituted alkyl group having 4 to 6 carbon atoms, and more preferably a n-butyl group.

In Formula (IV), Q represents a non-metallic group necessary to form a 5- to 7-membered ring together with —N═C—N($(CH_2)_3$O—$R^1$)—. The 5- to 7-membered ring thus formed is preferably a substituted or unsubstituted monocyclic or condensed hetero ring, and more preferably ring-forming atoms are selected from carbon, nitrogen, or sulfur atoms. Further preferably Q represents —C(—R11)═C(—R12)-$SO_2$—, or —C(—R11)═C(—R12)-CO—. In the invention, the expression of these groups does not limit a bonding direction thereof. R11 and R12 bond to each other to form a 5- to 7-membered ring together with —C═C—, or alternatively each independently represent a hydrogen atom, or a substituent. The 5- to 7-membered ring thus formed is a saturated or unsaturated ring which may be acyclic, aromatic or heterocyclic. Examples of the ring include a benzene ring, a furan ring, a thiophene ring, a cyclopentane ring, and a cyclohexane ring. Further, these rings may have a substituent. Examples of the substituent include those listed as a substituent which the above-described alkyl group of $R^1$ may have (hereinafter, also referred to as a substituent of $R^1$)

Each of these substituents and the ring that has been formed by mutual bonding of two or more substituents may be further substituted with a substituent, examples of which include those listed as the aforementioned substituent of $R^1$.

In Formula (IV), $R^2$ represents a substituent except for a hydrogen atom. Examples of the substituent include those listed as the aforementioned substituent of $R^1$. Examples of $R^2$ include a halogen atom (for example, fluorine, chlorine, bromine), an alkyl group (for example, methyl, isopropyl, t-butyl), an aryl group (for example, phenyl, naphthyl), an alkoxy group (for example, methoxy, isopropyl oxy), an aryloxy group (for example, phenyloxy), an alkylthio group (for example, methylthio, octylthio), an arylthio group (for example, phenylthio, 2-methoxyphenylthio), an acyloxy group (for example, acetyloxy), an amino group (for example, dimethylamino, morpholino), an acylamino group (for example, acetamide), a sulfonamide group (for example, methane sulfonamide, benzene sulfonamide), an alkoxycarbonyl group (for example, methoxycarbonyl), an aryloxycarbonyl group (for example, phenoxycarbonyl), a carbamoyl group (for example, N-methylcarbamoyl, N,N-diethylcarbamoyl), a sulfamoyl group (for example, N-methylsulfamoyl, N,N-diethylsulfamoyl), an alkylsulfonyl group (for example, methane sulfonyl), an arylsulfonyl group (for example, benzene sulfonyl), a cyano group, a carboxyl group, and a sulfo group. The substituent of $R^2$ is more preferably an alkyl group, an aryl group, an alkoxy group, or an aryloxy group.

The total carbon number of $R^2$ is preferably from 0 to 60, more preferably from 0 to 50, and further preferably from 0 to 40.

$R^2$ is more preferably a t-alkyl group, further preferably a t-butyl group, and still further preferably a t-butyl group in the para-position with respect to —$SR^4$.

In Formula (IV), m represents an integer of 0 to 4. When m is two or more, a plurality of $R^2$'s each may be the same or different from each other. Alternatively, they may bond to each other to form a ring. In the second aspect of the invention, m is preferably 0 or 1.

In Formula (IV), $R^4$ represents a primary alkyl group. The alkyl group may have a substituent. Examples of the substituent include those listed as the aforementioned substituent of $R^1$. A preferable carbon number of $R^4$ including the substituent thereof is from 3 to 30, more preferably from 3 to 20, and further preferably from 6 to 12. As a preferable substituent, an alkyl group and an aryl group are listed. As a further preferable substituent, an alkyl group is listed. $R^4$ is most preferably 2-ethylhexyl group.

Herein, where the carbon atom bond to S in the Formula (IV) is called as a central carbon in the carbon skeleton of alkyl group, the term "primary alkyl group" refers to an alkyl group in which the central carbon has at least two hydrogen atoms.

In Formula (IV), X represents a hydrogen atom, or a releasing group that is releasable upon a coupling reaction with an oxidized color developing agent. When X is a releasing group that is releasable upon a coupling reaction with an oxidized color developing agent, examples of the releasing group include a group releasing with a nitrogen atom, a group releasing with an oxygen atom, a group releasing with a sulfur atom, and a halogen atom (for example, chlorine, bromine).

Examples of the group releasing with a nitrogen atom include a heterocyclic group (preferably 5- to 7-membered substituted or unsubstituted saturated or unsaturated aryl (herein the term "aryl" means a group having cyclic conjugated electrons of 4n+2) or non-aryl monocyclic or condensed heterocyclic groups, and more preferably 5- to 6-membered heterocyclic groups wherein ring-forming atoms are selected from a carbon atom, a nitrogen atom, or a sulfur atom, and at least one hetero atom selected from the group consisting of a nitrogen atom, an oxygen atom and a sulfur atom is contained, and specific examples of the heterocycles include succinimide, maleimide, phthalimide, diglycolimide, pyrrol, pyrazole, imidazole, 1,2,4-triazole, tetrazole, indole, benzopyrazole, benzimidazole, benzotriazole, imidazolizine-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxyprine, parabanic acid, 1,2,4-triazolidine-3,5-dione, 2-pyridone, 4-pyridone, 2-pyrimidone, 6-pyridazone, and 2-pyrazone, 2-amino-1,3,4-thiazolidine-4-one); a carbonamide group (for example, acetamide, trifluoroacetamide); a sulfonamide group (for example, methane sulfonamide, benzene sulfonamide); an arylazo group (for example, phenylazo, naphthylazo); a carbamoylamino group (for example, N-methylcarbamoylamino).

Among these groups releasing with a nitrogen atom, a preferable group is a heterocyclic group, and a more preferable group is an arylheterocyclic group having 1, 2, 3, or 4 nitrogen atoms as a ring-forming atom, or a heterocyclic group represented by the following Formula (L).

Formula (L)

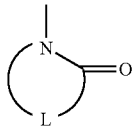

wherein, in Formula (L), L represents a residual group necessary to form a 5- or 6-membered nitrogen-containing heterocycle together with —NC(=O)—.

Examples of these heterocyclic groups have been listed already in the above descriptions of the heterocyclic group, and specific heterocycles listed therein are more preferable. Especially, L is preferably a residual group necessary to form a 5-membered nitrogen-containing heterocycle.

Examples of the group releasing with an oxygen atom include an aryloxy group (for example, phenoxy, 1-naphthoxy), a heterocyclicoxy group (for example, pyridyloxy, pyrazolyloxy), an acyloxy group (for example, acetoxy, benzoyloxy), an alkoxy group (for example, methoxy, dodecyloxy), a carbamoyloxy group (for example, N,N-diethyl carbamoyloxy, morpholinocarbamoyloxy), an aryloxycarbonyloxy group (for example, phenoxycarbonyloxy), an alkoxycarbonyloxy group (for example, methoxycarbonyloxy, ethoxycarbonyloxy), an alkylsulfonyloxy group (for example, methane sulfonyloxy), and an arylsulfonyloxy group (for example, benzene sulfonyloxy, toluene sulfonyloxy).

Among these groups releasing with an oxygen atom, preferable groups are an aryloxy group, an acyloxy group and a heterocyclicoxy group.

Examples of the group releasing with a sulfur atom include an arylthio group (for example, phenylthio, naphthylthio), a heterocyclic thio group (for example, tetrazolyl thio, 1,3,4-thiadiazolyl thio, 1,3,4-oxazolyl thio, benzimidazolyl thio), an alkylthio group (for example, methylthio, octylthio, hexadecylthio), an alkylsulfinyl group (for example, methane sulfinyl), an arylsulfinyl group (for example, benzene sulfinyl), an arylsulfonyl group (for example, benzene sulfonyl), and an alkylsulfonyl group (for example, methane sulfonyl).

Among these groups releasing with a sulfur atom, preferable groups are an arylthio group and a heterocyclic thio group, and a more preferable group is a heterocyclic thio group.

X may be substituted with a substituent. Examples of the substituent with which X is substituted include those listed as the aforementioned substituent of $R^1$.

X is preferably a group releasing with a nitrogen atom, a group releasing with an oxygen atom, or a group releasing with a sulfur atom, and more preferably a group releasing with a nitrogen atom. Further, preferable examples thereof are still more preferred in the preference order described with respect to the group releasing with a nitrogen atom. The most preferable releasing group is a 5,5-dimethyloxazolidine-2,4-dione-3-yl group.

Meanwhile, X may be a photographically useful group. Examples of the photographically useful group include a development inhibitor, a desilverizing accelerator, a redox compound, a dye, and a coupler, or precursors thereof.

In order to make a coupler immobilize in a photosensitive material, carbon numbers of at least one of Q, $R^1$, X, or $R^2$ are preferably from 8 to 60, and more preferably from 8 to 50 in terms of the total carbon atoms including a substituent thereof.

In the second aspect of the invention, it is preferable that the compound represented by the Formula (IV) is a compound represented by the following Formula (V) (herein, also referred to as a yellow dye-forming coupler). The compounds represented by Formula (V) are described in detail below.

Formula (V)

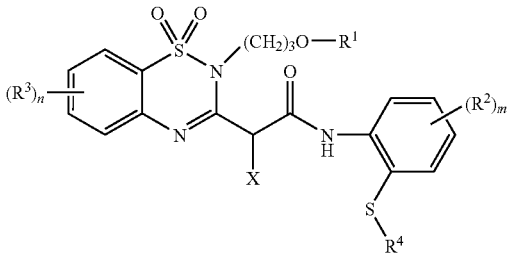

In Formula (V), $R^1$, $R^2$, $R^4$, m, and X each have the same meaning as $R^1$, $R^2$, $R^4$, m, and X described in the Formula (IV), and preferable ranges of $R^1$, $R^2$, $R^4$, m, and X are also the same as those of $R^1$, $R^2$, $R^4$, m, and X described in the Formula (IV).

In Formula (V), $R^3$ represents a substituent. Examples of the substituent include those listed as the aforementioned substituent of $R^1$. $R^3$ is preferably a halogen atom (for example, fluorine, chlorine, bromine), an alkyl group (for example, methyl, isopropyl), an aryl group (for example, phenyl, naphthyl), an alkoxy group (for example, methoxy, isopropyl oxy), an aryloxy group (for example, phenyloxy), an acyloxy group (for example, acetyloxy), an amino group (for example, dimethylamino, morpholino), an acylamino group (for example, acetamide), a sulfonamide group (for example, methane sulfonamide, benzene sulfonamide), an alkoxycarbonyl group (for example, methoxycarbonyl), an aryloxycarbonyl group (for example, phenoxycarbonyl), a carbamoyl group (for example, N-methylcarbamoyl, N,N-diethylcarbamoyl), a sulfamoyl group (for example, N-methylsulfamoyl, N,N-diethylsulfamoyl), an alkylsulfonyl group (for example, methane sulfonyl), an aryllsulfonyl group (for example, benzene sulfonyl), a cyano group, a carboxyl group, and a sulfo group.

n represents an integer of 0 to 4. When n is 2 or more, a plurality of $R^3$'s may be the same or different, and may bond to each other to form a ring.

Specific examples of the coupler represented by the Formula (IV) include those described in paragraphs [0047] to [0054] of JP-A-No. 2004-361936. However, the present invention is not limited to these compounds. Meanwhile, tautomers of couplers in which a hydrogen atom in the coupling position has been moved to the nitrogen atom of the —C═N portion bonded to the coupler in the coupling position are also included in the present invention.

The following compounds are listed as a compound that releases a residual group of a photographically useful compound upon a coupling reaction with an oxidized color developing agent.

Development inhibitor-releasing compounds: compounds represented by Formula (I), (II), (III), or (IV) on page 11 of European Patent EP 378,236 A1 (especially, T-101 (page 30), T-104 (page 31), T-113 (page 36), T-131 (page 45), T-144 (page 51), T-158 (page 58)), compounds represented by Formula (I) on page 7 of European Patent EP 436,938 A2 (especially, D-49(page 51), compounds represented by Formula (1) of JP-A-No. 5-307248 (especially, (23) in paragraph [0027]), and compounds represented by Formula (I), (II), or (III) on pages 5 to 6 of European Patent EP 440,195 A2 (especially, I-(1) on page 29);

Bleach accelerator-releasing compounds: compounds represented by Formula (I) or (I') on page 5 of European Patent EP 310,125 A2 (especially, (60), (61)), and compounds represented by Formula (I) in claim 1 of JP-A-No. 6-59411 (especially, (7) in paragraph [0022]);

Ligand-releasing compounds: compounds represented by LIG-X described in claim 1 of U.S. Pat. No. 4,555,478 (especially, compounds in column 12, lines 21 to 41);

Leuco dye-releasing compounds: compounds 1 to 6 in columns 3 to 8 of U.S. Pat. No. 4,749,641;

Fluorescence dye-releasing compounds: compounds represented by COUP-DYE in claim 1 of U.S. Pat. No. 4,774,181 (especially, compounds 1 to 11 in columns 7 to 10);

Development accelerator or fogging agent-releasing compounds: compounds represented by Formula (1), (2), or (3) in column 3 of U.S. Pat. No. 4,656,123 (especially, (I-22) in column 25) and ExZK-2 on page 75, lines 36 to 38 of European Patent EP 450,637 A2;

Compounds releasing a group that functions as a dye only after release: compounds represented by Formula (I) in claim 1 of U.S. Pat. No. 4,857,447 (especially, Y-1 to Y-19 in columns 25 to 36).

The following materials are preferable as additives except for the dye-forming coupler.

Dispersants for oil-soluble organic compound: P-3, P-5, P-16, P-19, P-25, P-30, P-42, P-49, P-54, P-55, P-66, P-81, P-85, P-86, and P-93 (pages 140 to 144) of JP-A-No. 62-215272;

Latexes for impregnating oil-soluble organic compound: latexes described in U.S. Pat. No. 4,199,363;

Oxidized developing agent scavengers: compounds represented by Formula (I) in column 2, lines 54 to 62 of U.S. Pat. No. 4,978,606 (especially, I-(1), I-(2), I-(6), I-(12) (columns 4 to 5) and compounds represented by Formula in column 2, lines 5 to 10 U.S. Pat. No. 4,923,787 (compound 1 in column 3));

Anti-stain agents: compounds represented by Formula (I), (II), or (III) on pages 4, lines 30 to 33 of European Patent EP 298321A, especially I-47, I-72, III-1, III-27 (pages 24 to 48);

Ant-fading agent: A-6, A-7, A-20, A-21, A-23, A-24, A-25, A-26, A-30, A-37, A-40, A-42, A-48, A-63, A-90, A-92, A-94, and A-164 (pages 69 to 118) described in European Patent EP 298321A, II-1 to III-23, especially III-10 in columns 25 to 38 of U.S. Pat. No. 5,122,444, and I-1 to III-4, especially II-2 on pages 8 to 12 of European Patent EP471347A, and A-1 to A-48, especially A-39, A-42 in columns 32 to 40 of U.S. Pat. No. 5,139,931;

Materials for decreasing a use amount of color development-enhancing agent or anti-color mixing agent: I-1 to II-15, especially I-46 on pages 5 to 24 of European Patent EP411324A; Formalin scavenger: SCV-1 to SCV-28, especially SCV-8 on pages 24 to 29 of European Patent EP477932A;

Hardeners: H-1, H-4, H-6, H-8 and H-14 on page 17 of JP-A-No. 1-214845, compounds (H-1 to H-54) represented by Formulae (VII) to (XII) in columns 13 to 23 of U.S. Pat. No. 4,618,573, compounds (H-1 to H-76, especially H-14)

represented by Formulae (6) on page 8, right lower column of JP-A-No. 2-214852, and compounds described in claim 1 of U.S. Pat. No. 3,325,287;

Development inhibitor precursors: P-24, P-37 and P-39 (pages 6 to 7) described in JP-A-No. 62-168139, and compounds described in claim 1 of U.S. Pat. No. 5,019,492, especially column 7, lines 28 to 29;

Antiseptic agents and Fungicides: I-1 to III-43, especially II-1, II-9, II-10, II-18, and III-25 in columns 3 to 15 of U.S. Pat. No. 4,923,790;

Stabilizers and anti-fogging agents: I-1 to (14), especially I-1, 60, (2), and (13) in columns 6 to 16 of U.S. Pat. No. 4,923,793, and compounds 1 to 65, especially 36 in columns 25 to 32 of U.S. Pat. No. 4,952,483;

Chemical sensitizers: triphenylphosphineselenide, and compound 50 described in JP-A-No. 5-40324;

Dyes: a-1 to b-20, especially a-1, a-12, a-18, a-27, a-35, a-36, b-5 on pages 15 to 18, and V-1 to V-23, especially V-1 on pages 27 to 29 of JP-A-No. 3-156450, F-I-1 to F-II-43, especially F-I-11 and F-II-8 on pages 33 to 55 of European Patent EP445627A, III-1 to III-36, especially III-1 and III-3 on pages 17 to 28 of European Patent EP457153A, compounds 1 to 22, especially compound 1 on pages 6 to 11 of European Patent EP319999A, compounds D-1 to D-87 (pages 3 to 28) represented by Formulae (1) to (3) of European Patent EP519306A, compounds 1 to 22 (column 3 to 10) represented by Formula (I) of U.S. Pat. No. 4,268,622, compounds (1) to (31) (column 2 to 9) represented by Formula (I) of U.S. Pat. No. 4,923,788, and compounds (II-1) to (II-29) represented by Formula (II) of JP-A-No. 2005-121744;

UV absorbents: compounds (18b) to (18r), and 101 to 427 (pages 6 to 9) represented by Formula (1) of JP-A-No. 46-3335, compounds (3) to (66) represented by Formula (1) (pages 10 to 14), and compounds HBT-1 to HBT-10 (page 14) represented by Formula (III) of European Patent EP520938A, and compounds (1) to (31) represented by Formula (1) (pages 2 to 9) of European Patent EP521823.

In the silver halide photosensitive material according to the second aspect of the invention, various kinds of additives other than the additives described above may be used in accordance with their purposes. General explanations of these additives are described in Research Disclosure Item 17643 (December 1978), ditto Item 18716 (November 1979) and ditto Item 308119 (December 1989) each cited in the first aspect of the invention. Pertinent portions thereof are shown together in the above-described table.

A proper support that can be used in the second aspect of the invention is described in, for example, page 28 of the above-described R D Item 17643; page 647, right column to left column of R D Item 18716; and page 879 of R D Item 307105.

The first interlayer used in the second aspect of the invention preferably contains as a component a lower layer and an antihalation layer, the lower layer being nearer to the support than the antihalation layer.

The lower layer preferably contains gelatin as a component. Various photographically useful materials such as an antioxidant, an ultraviolet absorbent, or an anti-fogging agent may be preferably contained therein in accordance with necessity.

At least one light-insensitive hydrophilic colloid layer having an antihalation function is used in the antihalation layer. A least one of colloidal silver or antihalation dyes is contained in the light-insensitive hydrophilic colloid layer having an antihalation function. In the color positive photosensitive material for motion picture, dyes are preferably used because it is necessary to form the movie soundtrack with a silver image. The dyes used for antihalation is not particularly limited, so long as the dye is effective to prevent antihalation and have substantially no adverse affect on photographic properties. The dye may be a water-soluble dye, or dye solid fine particle dispersion. In view of effects of the invention, the dye solid fine particle dispersion is preferable.

In the photosensitive material according to the second aspect of the invention, it is preferable to dispose a back layer having a total dried film thickness of 0.01 to 20 μm on the support of the side opposite to the side that is provided with emulsion layers. In this back layer, it is preferable to contain, for example, a light absorber, a filter dye, an ultraviolet absorbent, an antistatic agent, a hardener, a binder, a plasticizer, a lubricant, a matting agent, a coating aid, or a surface active agent. Among these materials, an antistatic agent is preferably used in particular. As the antistatic agent, at least one compound is preferably used which is selected from the group consisting of transparent metal oxide electrically-conductive materials such as tin oxide, tin oxide doped with a metal such as antimony, or tin-doped iridium oxide and electrically-conductive organic polymer materials such as polythiophene, or polyaniline. Among these materials, antimony-doped tin oxide is preferably used in particular.

The silver halide photosensitive material according to the second aspect of the invention may be produced by coating at one time a coating liquid for a first interlayer, a coating liquid for a blue-sensitive silver halide emulsion layer, a coating liquid for a second interlayer, a coating liquid for a red-sensitive silver halide emulsion layer, a coating liquid for a third interlayer, a coating liquid for a green-sensitive silver halide emulsion layer, and a coating liquid for a protective layer on a long support according to a simultaneous multilayer coating, and setting and then drying these coating layers. In this occasion, it is inevitable in a production environment that a fine iron powder or the like is caught up in air and adheres to the surface of the support just before the above-described coating liquids are coated thereon. However, by incorporating a chelating agent in the coating liquid for the first interlayer, a reaction between the iron powder and light-sensitive silver halide grains in the photographic emulsion are suppressed, whereby the metal defects can be prohibited effectively.

In contrast, when the chelating agent is incorporated in a coating liquid for the blue-sensitive silver halide emulsion layer, the chelating agent reacts with light-sensitive silver halide grains in the photographic emulsion, thereby causing deterioration of photographic properties such as increase in fogging. Beside, when the chelating agent is incorporated in a coating liquid for the third interlayer that is arranged at a further position from the support, it takes a time until an iron powder contaminating the surface of the support reacts with the chelating agent to produce an iron chelate. As a result, during the period of time when the iron chelate is produced, the iron powder becomes to react with light-sensitive silver halide grains (for example, silver halide grains in a coating liquid for the r the blue-sensitive silver halide emulsion layer), which results in occurrence of spot fog. Therefore, it is very important to incorporate a chelating agent in a first interlayer.

Alternatively, when a coating liquid for the first interlayer, a coating liquid for the blue-sensitive silver halide emulsion layer, a coating liquid for the second interlayer, a coating liquid for the red-sensitive silver halide emulsion layer, a coating liquid for the third interlayer, a coating liquid for the green-sensitive silver halide emulsion layer, and a coating liquid for the protective layer are coated at two times on or above a long support provided with a undercoat layer if needed, according to a simultaneous multilayer coating method, for example, at the first coating step, a coating liquid for the first interlayer, a coating liquid for the blue-sensitive silver halide emulsion layer and a coating liquid for the second interlayer are simultaneously coated on the support, and then set and dried, and then at the second coating step, on these layers, a coating liquid for the red-sensitive silver halide emulsion layer, a coating liquid for the third interlayer, a coating liquid for the green-sensitive silver halide emulsion layer, and a coating liquid for the protective layer are simultaneously coated, and then set and dried, thereby producing a finished silver halide photosensitive material, it is preferable to incorporate a chelating agent also in the second interlayer in addition to the first interlayer. This is because, with respect to the iron powder having contaminated the surface of the support, the chelating agent incorporated in the first interlayer forms an iron chelate, and in contrast, with respect to the iron powder having contaminated the surface of the coating layer (for example, in this case, the surface of the first interlayer), the chelating agent incorporated in the second interlayer effectively functions.

The silver halide photosensitive material according to the second aspect of the invention is most preferably applied to a color positive for motion picture. In the second aspect of the invention, the effect attained in the color positive for motion picture is particularly conspicuous because spot fog can be reduced to a minimum level.

The silver halide photosensitive material for motion picture according to the second aspect of the invention may be processed according to standard process steps for processing the positive photosensitive material for motion picture.

| Conventional standard processing steps for photosensitive material for motion picture (except for drying) |
|---|
| (1) Color developer bath |
| (2) Stop bath |
| (3) Wash bath |
| (4) First fixing bath |
| (5) Wash bath |
| (6) Bleach accelerating bath |
| (7) Bleaching bath |
| (8) Wash bath |
| (9) Sound development (smearing development) |
| (10) Washing |
| (11) Second fixing bath |
| (12) Wash bath |
| (13) Stabilizing bath |

In the second aspect of the invention, among the above-described processing steps, a processing time in the color developer bath (the step of (1)) is preferably 2 minutes and 45 seconds or less (the lower limit is preferably 6 seconds or more, more preferably 10 seconds or more, further preferably 20 seconds or more, and still further preferably 30 seconds or more), more preferably 2 minutes and 30 seconds or less (the lower limit is preferably 6 seconds or more, more preferably 10 seconds or more, further preferably 20 seconds or more, and still further preferably 30 seconds or more), whereby preferable results are obtained.

It is possible to omit the step of (6) using the bleach accelerating bath depending on the kind of processing solution used in the bleaching bath of the step of (7).

Further, in the case where sound development in the step of (9) is not needed, omission of each of the steps consisting of first fixing bath (4), wash bath (5), sound development (9), and washing (10) is a preferable embodiment.

EXAMPLES

Examples of the first aspect of the invention are described below. However, the first aspect of the invention is not limited to these examples.

Example 1

Sample 1 was produced in the same manner as the sample 101 described in Example 1 of JP-A No. 2008-145958, except that the below-described iron powder contamination layer was disposed as a first layer before disposing a low sensitivity red-sensitive emulsion layer. The first layer is a layer for making it easier to mandatorily reproduce a spot-like contamination arising from a metal. This layer was disposed in order to quantitatively evaluate the number of spots in the evaluation of photographic properties. Accordingly, the sample 101 has such a constitution that a cellulose triacetate film support has on one surface thereof a first layer (iron powder contamination layer), a second layer (low sensitivity red-sensitive emulsion layer), a third layer (middle sensitivity red-sensitive emulsion layer), a forth layer (high sensitivity red-sensitive emulsion layer), a fifth layer (a first interlayer), a sixth layer (low sensitivity green-sensitive emulsion layer), a seventh layer (middle sensitivity green-sensitive emulsion layer), a eighth layer (high sensitivity green-sensitive emulsion layer), a ninth layer (yellow filter layer), a tenth layer (low sensitivity blue-sensitive emulsion layer), a eleventh layer (middle sensitivity blue-sensitive emulsion layer), a twelfth layer (high sensitivity blue-sensitive emulsion layer), a thirteenth layer (first protective layer), and a fourteenth layer (second protective layer), and further a back layer on the opposite surface (back surface) of the support. The coating of each layer was performed using a technique whereby, on a long cellulose triacetate film support having a back layer on the back surface thereof, at first a coating liquid for the first layer (iron powder contamination layer) was coated and dried to dispose the first layer, and then from a liquid coating for the second layer to a liquid coating for the fourteenth layer were once coated in membrane by using a GISSER, and set and then dried at 35° C. to dispose from the second layer to the fourteenth layer on the first layer coated on the film support. The color negative photosensitive material produced as described above is designated as sample 101. The first layer (layer for mandatorily reproducing a spot-like contamination arising from a metal) was produced in coating amounts of 0.0009 g/m$^2$ of finely pulverized iron powder and 0.406 g/m$^2$ of gelatin.

Production of Samples 102 to 108

Samples 102 to 108 were produced in the same manner as the sample 101, except that EDTA.2 Na was each added as a chelating agent to the fifth layer, the ninth layer, or the thirteenth layer, each of which is a non-emulsion layer, as shown in the following Table 1.

TABLE 1

| Sample No. | Chelating Agent Addition Amount*1 | Chelating Agent Addition Layer |
|---|---|---|
| 101 | 0 | — |
| 102 | 0.54000 | 5$^{th}$ Layer (First Interlayer) |
| 103 | 0.27000 | 5$^{th}$ Layer (First Interlayer) |
| 104 | 0.01125 | 5$^{th}$ Layer (First Interlayer) |
| 105 | 0.00140 | 5$^{th}$ Layer (First Interlayer) |
| 106 | 0.00140 | 2$^{nd}$ Layer (Emulsion Layer*2) |
| 107 | 0.00140 | 9$^{th}$ Layer (Yellow Filter Layer |
| 108 | 0.00140 | 13$^{th}$ Layer (Protective Layer) |

*1: g/m$^2$

*2: Low-sensitivity Red-sensitive Silver halide Emulsion Layer

Production of Samples 109 to 115

Samples 109 to 115 were produced in the same manner as the samples 102 to 108, except that the chelating agent was changed to NTA.3 Na and the addition amount was changed as shown in the following Table 2. In the Table 2, the addition amounts of the NTA.3 Na are each shown in $g/m^2$ and mol-reduced quantity. Further in the Table 2, the addition amounts of the EDTA.2 Na are also each shown in $g/m^2$ and mol-reduced quantity.

TABLE 2

| Sample No. | Addition Amount of Chelating Agent | |
|---|---|---|
| | $g/m^2$ | $mol/m^2$ |
| 102 | 0.54 | $1.5 \times 10^{-3}$ |
| 103 | 0.27 | $7.3 \times 10^{-4}$ |
| 104 | 0.01125 | $3.0 \times 10^{-5}$ |
| 105 | 0.0014 | $3.8 \times 10^{-6}$ |
| 106 | 0.0014 | $3.8 \times 10$ |
| 107 | 0.0014 | $3.8 \times 10$ |
| 108 | 0.0014 | $3.8 \times 10$ |
| 109 | 0.3993 | $1.5 \times 10^{-3}$ |
| 110 | 0.19965 | $7.3 \times 10^{-4}$ |
| 111 | 0.00832 | $3.0 \times 10^{-5}$ |
| 112 | 0.00103 | $3.8 \times 10^{-6}$ |
| 113 | 0.00103 | $3.8 \times 10$ |
| 114 | 0.00103 | $3.8 \times 10$ |
| 115 | 0.00103 | $3.8 \times 10$ |

Evaluation of Samples

To each sample, 1/100 second white exposure was carried out via wedge. Each exposed sample was processed in the same manner as the method described in Example 1 of JP-A No. 2008-145958. Then, density measurement of the thus-obtained image was conducted according to the method described in Example 1 of JP-A No. 63-226650. Further, each unexposed sample was processed to count the number of spot-like contamination generated in the each sample.

Evaluation of Photographic Properties

Based on the photographic properties of the sample 101 thus obtained according to the method described above, a difference in Fresh photographic properties between the samples 102 to 115 and the sample 101, and a difference in photographic properties during storage between the samples 102 to 115 and the sample 101 were each obtained. The storage condition was set at a temperature of 60° C. and a relative humidity of 30% for 3 days. It can be said that the smaller the difference in photographic properties between the test sample and the reference sample 101 free of a chelating agent, the less the deterioration of photographic properties arising from addition of the chelating agent and accordingly the more excellent the test sample.

Herein, it is best that the difference in Fresh photographic properties is equal to those of the sample 101. However, where a fog density is 0.05 or less, the difference is within an acceptable range. In contrast, where a fog density is more than 0.05, the difference is out of the acceptable range.

Further, with respect to a difference in photographic properties during storage, where a fog density is 0.20 or less based on the fresh photographic density, the difference in photographic properties during storage is within an acceptable range. The fog density is preferably 0.09 or less.

Further, the number of spots in the samples produced by the above-described method was observed. The spot number of each sample was qualified in relative numerical terms, providing that the spot number of sample 101 was 100.

Where the spot number of sample 101 was 100, if the spot number is 40 or less, the spot number is within an acceptable range. The spot number is preferably 25 or less, further preferably 10 or less, and most preferably 0. The thus-obtained results are shown in Table 3.

TABLE 3

| Sample No. | Chelating Agent | Layer containing Chelating Agent | Difference in Fresh Photographic properties | Difference in Photographic properties during Storage based on Fresh Photographic Density | Spot Number (Relative Value) |
|---|---|---|---|---|---|
| 101 | — | — | Standard | 0.08 | 100 |
| 102 | EDTA•2Na | First Interlayer | Equiv. to Standard | 0.18 | 0 |
| 103 | EDTA•2Na | First Interlayer | Equiv. to Standard | 0.15 | 0 |
| 104 | EDTA•2Na | First Interlayer | Equiv. to Standard | 0.09 | 0 |
| 105 | EDTA•2Na | First Interlayer | Equiv. to Standard | 0.08 | 0 |
| 106 | EDTA•2Na | Low sensitivity Red-sensitive Silver Halide Emulsion Layer | 0.20 | 0.10 | 0 |
| 107 | EDTA•2Na | Yellow Filter Layer | Equiv. to Standard | 0.08 | 45 |
| 108 | EDTA•2Na | Protective Layer | Equiv. to Standard | 0.08 | 49 |
| 109 | NTA•3 Na | First Interlayer | Equiv. to Standard | 0.11 | 6 |
| 110 | NTA•3 Na | First Interlayer | Equiv. to Standard | 0.10 | 10 |
| 111 | NTA•3 Na | First Interlayer | Equiv. to Standard | 0.08 | 20 |
| 112 | NTA•3 Na | First Interlayer | Equiv. to Standard | 0.08 | 20 |
| 113 | NTA•3 Na | Low sensitivity Red-sensitive Silver Halide Emulsion Layer | 0.05 | 0.09 | 48 |
| 114 | NTA•3 Na | Yellow Filter Layer | Equiv. to Standard | 0.08 | 60 |
| 115 | NTA•3 Na | Protective Layer | Equiv. to Standard | 0.08 | 73 |

As is apparent from Table 3, it is understood that samples 102 to 105, and 109 to 112 according to the first aspect of the invention each enable to minimize the difference in Flesh photographic properties/the difference in photographic properties during storage that are caused when a chelating agent is added thereto, and further to realize conspicuous reduction of the spot number which shows a great improvement effect on prevention of metal contamination.

In contrast, the sample 106 having a low sensitivity red-sensitive silver halide emulsion layer containing a chelating agent therein showed a serious defect of conspicuous increase in fog of the red-sensitive silver halide emulsion layer. Further, it is understood that samples 107, 108, 113, 114, and 115 wherein a chelating agent is each contained in a low sensitivity red-sensitive silver halide emulsion layer, or a yellow filter layer, or a protective layer each have an insufficient capacity of preventing an occurrence of spot Next, Examples of the second aspect of the invention are described below. However, the second aspect of the invention is not limited to these examples.

Example 2

Preparation of Support

Both surfaces of a 120 μm thick polyethyleneterephthalate (PET film) were subjected to corona discharge processing after biaxial stretching. Then, an undercoat layer containing styrene/butadiene copolymer and gelatin as a component was provided on a surface of the PET film for coating an emulsion layer. Further, on another surface of the PET film opposite to the surface for coating an emulsion layer, an acrylic resin layer containing antimony-doped tin oxide fine particles, a polymethacrylate matting agent and a colloidal silica matting agent was coated.

Preparation of Silver Halide Emulsion

Preparation of Blue-Sensitive Layer Emulsion BH-1

High silver chloride cubic grains were prepared by a method in which sulfuric acid was added to deionization water containing a deionization gelatin while stirring to adjust pH to 2.0, and then a 1% aqueous solution of Pluronic (registered trademark) 31R1 manufactured by BASF (3.0 cc per mol of finished silver halide) was added, and then silver nitrate and sodium chloride were simultaneously added and mixed to form a silver halide. During this preparation, between the time when 80% of the silver nitrate had been added and the time when 90% of the silver nitrate had been added, $K_4[Fe(CN)_6]$ ($1.4\times10^{-5}$ mol per mol of the finished silver halide) and $K_2[IrCl_5$ (5-methylthiazole)] ($4.2\times10^{-9}$ mol per mol of the finished silver halide) were continuously added. Further, between the time when 90% of the silver nitrate was added and the time when 100% of the silver nitrate had been added, potassium bromide (0.5% by mol relative to the total amount of the finished silver halide) and $K_2[IrCl_5(H_2O)]$ ($3.6\times10^{-6}$ mol per mol of the finished silver halide) were continuously added. Further, between the time when 92% of the silver nitrate was added and the time when 94% of the silver nitrate had been added, potassium iodide (0.20% by mol relative to the total amount of the finished silver halide) was continuously added while vigorously stirring. The thus-obtained emulsion grains were mono-dispersed cubic silver iodobromochloride grains having a side length of 0.6 μM and variation coefficient of 8.0%. This emulsion was subjected to a deposition desalting processing. Thereafter, to the emulsion, a deionization gelatin and the following additives were added and re-dispersed. Namely, the additives herein added were a 1% aqueous solution of Pluronic (registered trademark) 31R1 manufactured by BASF (3.9 cc per mol of the finished silver halide), an antiseptic agent represented by the following Ab-1 (0.05 g per Kg of the chemically sensitized finished emulsion), an antiseptic agent represented by the following Ab-2 (0.05 g per Kg of the chemically sensitized finished emulsion), an antiseptic agent represented by the following Ab-3 (5.0 g per Kg of the chemically sensitized finished emulsion), and calcium nitrate (2.8 g per Kg of the chemically sensitized finished emulsion). The halogen composition (%) of the emulsion grains was Cl/Br/I=99.3/0.5/0.2.

(Ab-1)

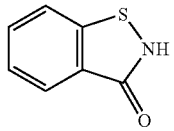

(Ab-2)

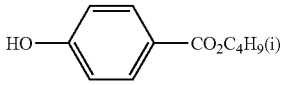

(Ab-3)

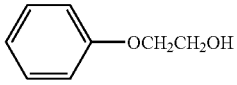

To the emulsion thus re-dispersed, a sodium hydroxide aqueous solution was added and the pH value of the emulsion was adjusted to 5.70 at 40° C. The emulsion was spectrally sensitized by adding thereto a sensitizing dye represented by the following S-1 ($3.6\times10^{-4}$ mol per mol of silver halide) and a sensitizing dye represented by the following S-2 ($7.9\times10^{-5}$ mol per mol of silver halide). Next, the emulsion was chemically sensitized by adding thereto sodium benzenethiosulfonate ($6.2\times10^{-6}$ mol per mol of silver halide), sodium thiosulfate pentahydrate ($1.3\times10^{-5}$ mol per mol of silver halide) as a sulfur sensitizer and chloroauric acid tetrahydrate ($7.4\times10^{-6}$ mol per mol of silver halide) as a gold sensitizer, and further by ripening the emulsion so that chemical sensitization was optimized. Then, 1-(5-methylureidophenyl)-5-mercaptotetrazole ($3.2\times10^{-4}$ mol per mol of silver halide), a compound represented by represented by the following C-1 ($1.0\times10^{-5}$ mol per mol of silver halide), a compound including two or three of recurring unit represented by the following C-2 (the terminal X1 and X2 each represent a hydroxyl group) ($1.2\times10^{-1}$ g per mol of silver halide) as a main component, a compound represented by the following C-3 ($7.8\times10^{-5}$ mol per mol of silver halide), and potassium bromide ($6.9\times10^{-3}$ mol per mol of silver halide) were added to complete chemical sensitization. The thus-obtained emulsion was designated as Emulsion BH-1. The finished emulsion contains 100 g of silver halide in equivalent to metal silver, and 69 g of gelatin per Kg of the finished emulsion.

S-1

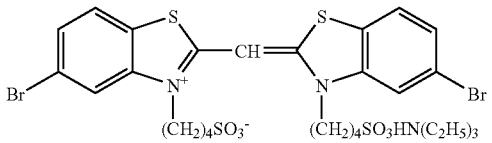

S-2

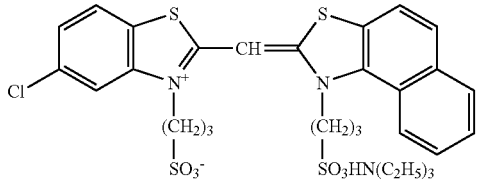

C-1

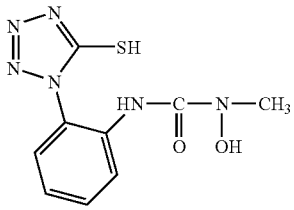

-continued

C-2

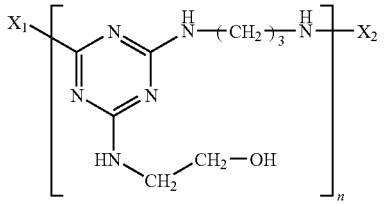

C-3

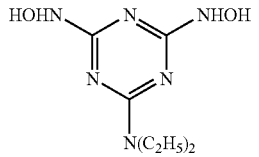

Preparation of Blue-Sensitive Layer Emulsion BM-1

High silver chloride cubic grains were prepared in the same as the preparation of the Emulsion BH-1, except for changing a temperature and an addition rate in the step of simultaneously adding silver nitrate and sodium chloride and mixing them. The thus-obtained emulsion grains were mono-dispersed cubic silver iodobromochloride grains having a side length of 0.43 μm and variation coefficient of 9.5%. This emulsion was re-dispersed by subjecting the emulsion to a deposition desalting processing in the same manner as in the Emulsion BH-1. Then, Emulsion BM-1 was prepared in the same as in the Emulsion BH-1, except that addition amounts of various compounds were each changed so that the amount of each compound per unit surface area of silver halide grain was the same as that of the Emulsion BH-1. The finished emulsion contains 99 g of silver halide in equivalent to metal silver, and 68 g of gelatin.

Preparation of Blue-Sensitive Layer Emulsion BL-1

High silver chloride cubic grains were prepared by a method in which sulfuric acid was added to deionization water containing an alkali-processed deionization gelatin while stirring to adjust pH to 2.0, and then a 1% aqueous solution of Pluronic (registered trademark) 31R1 manufactured by BASF (3.0 cc per mol of finished silver halide) was added, and then silver nitrate and sodium chloride were simultaneously added and mixed to form a silver halide. During this preparation, between the time when 70% of the silver nitrate had been added and the time when 85% of the silver nitrate had been added, $K_4[Fe(CN)_6]$ ($1.3\times10^{-5}$ mol per mol of the finished silver halide), $K_2[IrCl_5$ (5-methylthiazole)] ($4.0\times10^{-9}$ mol per mol of the finished silver halide) and $K_3[RhBr_5(H_2O)]$ ($1.2\times10^{-8}$ mol per mol of the finished silver halide) were continuously added. Further, between the time when 85% of the silver nitrate had been added and the time when 100% of the silver nitrate had been added, potassium bromide (0.5% by mol relative to the total amount of the finished silver halide) and $K_2[IrCl_5(H_2O)]$ ($7.7\times10^{-6}$ mol per mol of the finished silver halide) were continuously added. Further, between the time when 92% of the silver nitrate had been added and the time when 94% of the silver nitrate had been added, potassium iodide (0.33% by mol relative to the total amount of the finished silver halide) was continuously added while vigorously stirring. The thus-obtained emulsion grains were mono-dispersed cubic silver iodobromochloride grains having a side length of 0.33 μm and variation coefficient of 10.0%. This emulsion was subjected to a deposition desalting processing. Thereafter, to the emulsion, an alkali-processed deionization gelatin and the following additives were added and re-dispersed. Namely, the additives herein added were a 1% aqueous solution of Pluronic (registered trademark) 31R1 manufactured by BASF (3.8 cc per mol of finished silver halide), Ab-1 (0.05 g per Kg of the chemically sensitized finished emulsion), Ab-2 (0.05 g per Kg of the chemically sensitized finished emulsion), Ab-3 (5.0 g per Kg of the chemically sensitized finished emulsion), and calcium nitrate (2.8 g per Kg of the chemically sensitized finished emulsion). The halogen composition (%) of the emulsion grains was Cl/Br/I=99.17/0.5/0.33.

To the emulsion thus re-dispersed, a sodium hydroxide aqueous solution was added and the pH value of the emulsion was adjusted to 5.70 at 40° C. Next, the emulsion was chemically sensitized by adding thereto sodium benzenethiosulfonate ($1.0\times10^{-5}$ mol per mol of silver halide), sodium thiosulfate pentahydrate ($2.1\times10^{-5}$ mol per mol of silver halide) as a sulfur sensitizer and chloroauric acid tetrahydrate ($1.4\times10^{-5}$ mol per mol of silver halide) as a gold sensitizer, and further by ripening the emulsion so that chemical sensitization was optimized. Then, 1-(5-methylureidophenyl)-5-mercaptotetrazole ($5.4\times10^{-4}$ mol per mol of silver halide), a compound represented by represented by the above-described C-1 ($1.0\times10^{-5}$ mol per mol of silver halide), a compound including two or three of recurring unit represented by the following C-2 (the terminal X1 and X2 each represent a hydroxyl group) ($2.0\times10^{-1}$ g per mol of silver halide) as a main component, a compound represented by represented by the above-described C-3 ($1.3\times10^{-4}$ mol per mol of silver halide), and potassium bromide ($5.2\times10^{-3}$ mol per mol of silver halide) were added to complete chemical sensitization. The thus-obtained emulsion was designated as Emulsion BL-1. The finished emulsion contains 103 g of silver halide in equivalent to metal silver, and 65 g of gelatin per Kg of the finished emulsion.

Preparation of Red-Sensitive Layer Emulsion RH-1

High silver chloride cubic grains were prepared by a method in which sulfuric acid was added to deionization water containing an alkali-processed deionization gelatin while stirring to adjust pH to 2.5, and then silver nitrate and sodium chloride were simultaneously added and mixed to form a silver halide. During this preparation, between the time when none of the silver nitrate had been added and the time when 50% of the silver nitrate had been added, potassium bromide was continuously added (32.5% by mol relative to the total amount of the finished silver halide). Further, between the time when 50% of the silver nitrate had been added and the time when 100% of the silver nitrate had been added, $K_4[Fe(CN)_6]$ ($1.7\times10^{-5}$ mol per mol of the finished silver halide), $K_2[IrCl_5$ (5-methylthiazole)] ($1.8\times10^{-7}$ mol per mol of the finished silver halide) and potassium bromide (17.5% by mol per mol of the finished silver halide) were continuously added. After addition of the silver nitrate was completed, a 1% aqueous solution of Pluronic (registered trademark) 31R1 manufactured by BASF (10.6 cc per mol of the finished silver halide) and a 2% aqueous solution of RNA-F3 manufactured by NIPPON PAPER Chemicals CO., LTD. (20.6 cc per mol of the finished silver halide) were added. The thus-obtained emulsion grains were mono-dispersed cubic silver chlorobromide grains having a side length of 0.23 μm and variation coefficient of 11.0%. This emulsion was subjected to a deposition desalting processing. Thereafter, to the emulsion, an alkali-processed deionization gelatin was added and re-dispersed. The halogen composition (%) of the emulsion grains was Cl/Br/I=75/25/0.

To the emulsion thus re-dispersed, a sodium hydroxide aqueous solution was added and the pH value of the emulsion was adjusted to 6.15 at 40° C. Next, the emulsion was chemically sensitized by adding thereto sodium benzenethiosulfonate ($7.7\times10^{-5}$ mol per mol of silver halide), triethylthiourea ($1.2\times10^{-5}$ mol per mol of silver halide) as a sulfur sensitizer and chloroauric acid tetrahydrate ($7.8\times10^{-6}$ mol per mol of silver halide) as a gold sensitizer, and further by ripening the emulsion so that chemical sensitization was optimized. Then, 1-(5-methylureidophenyl)-5-mercaptotetrazole ($1.6\times10^{-3}$ mol per mol of silver halide), a compound represented by represented by the following C-4 ($1.0\times10^{-3}$ mol per mol of silver halide) were added to complete chemical sensitization. Subsequently, the emulsion was spectrally sensitized by adding thereto a sensitizing dye represented by the following S-3 ($5.1\times10^{-5}$ mol per mol of silver halide) and a compound represented by the following C-5 ($8.5\times10^{-4}$ mol per mol of silver halide). Finally, compound Ab-1 (0.05 g per Kg of the chemically sensitized finished emulsion) and compound Ab-3 (6.0 g per Kg of the chemically sensitized finished emulsion) were added. The thus-obtained emulsion was designated as Emulsion RH-1. The finished emulsion contains 85 g of silver halide in equivalent to metal silver, and 71 g of gelatin per Kg of the finished emulsion.

fonate ($6.2\times10^{-5}$ mol per mol of silver halide), triethylthiourea ($2.4\times10^{-5}$ mol per mol of silver halide) as a sulfur sensitizer and chloroauric acid tetrahydrate ($1.3\times10^{-5}$ mol per mol of silver halide) as a gold sensitizer, and further by ripening the emulsion so that chemical sensitization was optimized. Then, 1-(5-methylureidophenyl)-5-mercaptotetrazole ($1.3\times10^{-3}$ mol per mol of silver halide), a compound represented by the above-described C-4 ($1.7\times10^{-3}$ mol per mol of silver halide) were added to complete chemical sensitization. Subsequently, the emulsion was spectrally sensitized by adding thereto a sensitizing dye represented by the above-described S-3 ($8.1\times10^{-5}$ mol per mol of silver halide) and a compound represented by the above-described C-5 ($9.5\times10^{-4}$ mol per mol of silver halide). Finally, compound Ab-1 (0.5 g per Kg of the chemically sensitized finished emulsion) and compound Ab-3 (10.1 g per Kg of the chemically sensitized finished emulsion) were added. The thus-obtained emulsion was designated as Emulsion RH-1. The finished emulsion contains 87 g of silver halide in equivalent to metal silver, and 73 g of gelatin per Kg of the finished emulsion.

C-4

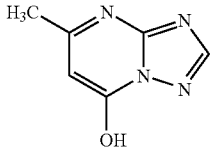

S-3

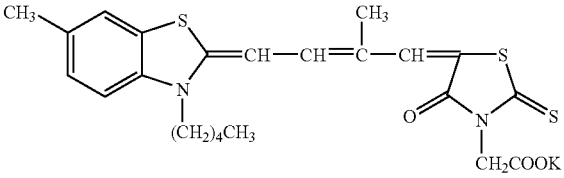

C-5

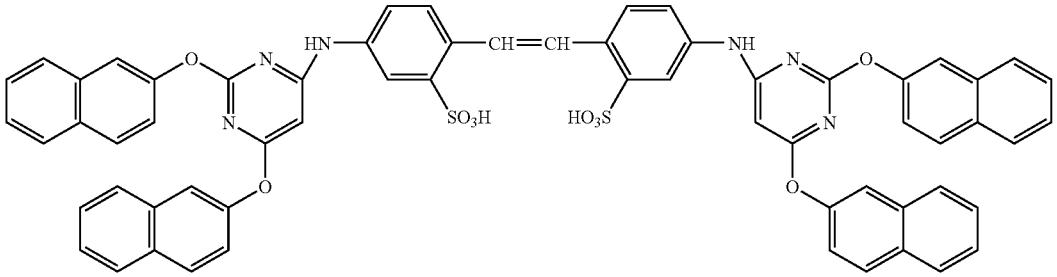

Preparation of Red-Sensitive Layer Emulsion RM-1

High silver chloride cubic grains were prepared in the same manner as in the preparation of the Emulsion RH-1, except that a temperature and an addition rate were changed in the step of simultaneously adding silver nitrate and sodium chloride and mixing them, and between the time when none of the silver nitrate had been added and the time when 50% of the silver nitrate had been added, $K_2[IrCl_6]$ ($2.3\times10^{-7}$ mol per mol of the finished silver halide) was newly and continuously added. Further, the amount of the 2% aqueous solution of RNA-F3 manufactured by NIPPON PAPER Chemicals CO., LTD. that was added after completion of addition of the silver nitrate was change to 27.6 cc per mol of the finished silver halide. The thus-obtained emulsion grains were mono-dispersed cubic silver chlorobromide grains having a side length of 0.14 μm and variation coefficient of 12.5%. This emulsion was re-dispersed by subjecting the emulsion to a deposition desalting processing in the same manner as in the Emulsion RH-1. The halogen composition (%) of the emulsion grains was Cl/Br/I=75/25/0.

To the emulsion thus re-dispersed, a sodium hydroxide aqueous solution was added and the pH value of the emulsion was adjusted to 6.15 at 40° C. Next, the emulsion was chemically sensitized by adding thereto sodium benzenethiosul- Preparation of Red-Sensitive Layer Emulsion RL-1

High silver chloride cubic grains were prepared in the same manner as in the preparation of the Emulsion RM-1, except that the amount of $K_2[IrCl_6]$ continuously added between the time when none of the silver nitrate had been added and the time when 50% of the silver nitrate had been added was changed to $2.9\times10^{-7}$ mol per mol of the finished silver halide. The thus-obtained emulsion grains were mono-dispersed cubic silver chlorobromide grains having a side length of 0.14 μm and variation coefficient of 12.5%. This emulsion was re-dispersed by subjecting the emulsion to a deposition desalting processing in the same manner as in the Emulsion RH-1. The halogen composition (%) of the emulsion grains was Cl/Br/I=75/25/0. Chemical sensitization and spectral sensitization were performed in the same manner as in the Emulsion RM-1, except that the addition amount of compound represented by the above-described C-5 was changed to $7.6\times10^{-5}$ mol per mol of silver halide, thereby shortening the period of time for chemical sensitization by 20 minutes. Finally, compound Ab-1 (0.05 g per Kg of the chemically sensitized finished emulsion) and compound Ab-3 (9.6 g per Kg of the chemically sensitized finished emulsion) were added. The thus-obtained emulsion was designated as Emulsion RL-1. The finished emulsion contains 87 g of silver halide in equivalent to metal silver, and 73 g of gelatin per Kg of the finished emulsion.

Preparation of Green-Sensitive Layer Emulsion GH-1

High silver chloride cubic grains were prepared by a method in which sulfuric acid was added to deionization water containing an alkali-processed deionization gelatin while stirring to adjust pH to 3.0, and a 0.5% aqueous solution of N,N-dimethylimidazolidine-2-thione ($7.2\times10^{-5}$ mol per mol of the finished silver halide) was added, and a 1% aqueous solution of Pluronic (registered trademark) 31R1 manufactured by BASF (4.7 cc per mol of the finished silver halide) was added, and silver nitrate and sodium chloride were simultaneously added and mixed to form a silver halide. During this preparation, between the time when none of the silver nitrate had been added and the time when 50% of the silver nitrate had been added, $K_2[IrCl_5$ (5-methylthiazole)] ($2.4\times10^{-8}$ mol per mol of the finished silver halide) were continuously added and between the time when 50% of the silver nitrate had been added and the time when 100% of the silver nitrate had been added, $K_4[Fe(CN)_6]$ ($3.0\times10^{-5}$ mol per mol of the finished silver halide) were continuously added. After addition of the silver nitrate was completed, a 2% aqueous solution of RNA-F3 manufactured by NIPPON PAPER Chemicals CO., LTD. (23.0 cc per mol of the finished silver halide) was added. Thereafter, the emulsion was spectrally sensitized by adding thereto a sensitizing dye represented by the following S-4 ($5.0\times10^{-4}$ mol per mol of silver halide). Finally, a compound represented by the above-described C-4 was added ($2.0\times10^{-4}$ mol per mol of silver halide). The thus-obtained emulsion grains were mono-dispersed cubic silver chloride grains having a side length of 0.18 μm and variation coefficient of 11.9%. This emulsion was subjected to a deposition desalting processing. Thereafter, to the emulsion, an alkali-processed deionization gelatin and calcium nitrate (0.84 g per Kg of the chemically sensitized finished emulsion) were added and re-dispersed. The halogen composition (%) of the emulsion grains was Cl/Br/I=100/0/0.

S-4

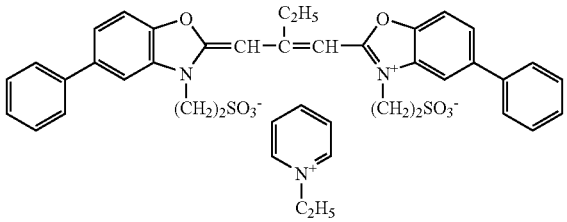

To the emulsion thus re-dispersed, a sodium hydroxide aqueous solution was added and the pH value of the emulsion was adjusted to 5.30 at 40° C. Next, the emulsion was chemically sensitized by adding thereto sodium benzenethiosulfonate ($2.7\times10^{-5}$ mol per mol of silver halide), triethylthiourea ($1.6\times10^{-5}$ mol per mol of silver halide) as a sulfur sensitizer and chloroauric acid tetrahydrate ($1.2\times10^{-5}$ mol per mol of silver halide) as a gold sensitizer, and further by ripening the emulsion so that chemical sensitization was optimized. Then, a compound represented by represented by the following C-6 ($9.3\times10^{-4}$ mol per mol of silver halide), 1-(5-methylureidophenyl)-5-mercaptotetrazole ($7.5\times10^{-4}$ mol per mol of silver halide), potassium bromide ($1.7\times10^{-2}$ mol per mol of silver halide), and a compound represented the following C-7 ($1.7\times10^{-4}$ mol per mol of silver halide) were added to complete chemical sensitization. Finally, compound Ab-1 (0.61 g per Kg of the chemically sensitized finished emulsion) and compound Ab-3 (4.5 g per Kg of the chemically sensitized finished emulsion) were added. The thus-obtained emulsion was designated as Emulsion GH-1. The finished emulsion contains 92 g of silver halide in equivalent to metal silver, and 65 g of gelatin per Kg of the finished emulsion.

C-6

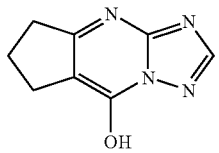

C-7

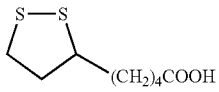

Preparation of Green-Sensitive Layer Emulsion GM-1

High silver chloride cubic grains were prepared in the same manner as in the preparation of the Emulsion GH-1, except that an addition rate was changed in the step of simultaneously adding silver nitrate and sodium chloride and mixing them, and the amount of $K_2[IrCl_5$ (5-methylthiazole)] continuously added between the time when none of the silver nitrate had been added and the time when 50% of the silver nitrate had been added was changed to $1.5\times10^{-7}$ mol per mol of the finished silver halide, and the amount of $K_4[Fe(CN)_6]$ continuously added between the time when 50% of the silver nitrate had been added and the time when 100% of the silver nitrate had been added was changed to $1.3\times10^{-5}$ mol per mol of the finished silver halide. Further, the amount of the 2% aqueous solution of RNA-F3 manufactured by NIPPON PAPER Chemicals CO., LTD. that was added after completion of addition of the silver nitrate was change to 31.2 cc per mol of the finished silver halide. Addition amount of the sensitizing dye represented by the aforementioned S-4 was changed to $2.4\times10^{-4}$ mol per mol of silver halide. The thus-obtained emulsion grains were mono-dispersed cubic silver chloride grains having a side length of 0.13 μm and variation coefficient of 13.7%. This emulsion was re-dispersed by subjecting the emulsion to a deposition desalting processing in the same manner as the Emulsion GH-1. The halogen composition (%) of the emulsion grains was Cl/Br/I=100/0/0.

To the emulsion thus re-dispersed, a sodium hydroxide aqueous solution was added and the pH value of the emulsion was adjusted to 5.30 at 40° C. Next, the emulsion was chemically sensitized by adding thereto sodium benzenethiosulfonate ($3.3\times10^{-5}$ mol per mol of silver halide), triethylthiourea ($1.8\times10^{-5}$ mol per mol of silver halide) as a sulfur sensitizer and chloroauric acid tetrahydrate ($1.5\times10^{-5}$ mol per mol of silver halide) as a gold sensitizer, and further by ripening them so that chemical sensitization was optimized. Then, a compound represented by represented by the above-described C-6 ($1.1\times10^{-3}$ mol per mol of silver halide), 1-(5-methylureidophenyl)-5-mercaptotetrazole ($8.8\times10^{-4}$ mol per mol of silver halide), potassium bromide ($2.0\times10^{-2}$ mol per mol of silver halide), and a compound represented the above-described C-7 ($1.9\times10^{-4}$ mol per mol of silver halide) were added to complete chemical sensitization. Finally, compound Ab-1 (0.59 g per Kg of the chemically sensitized finished emulsion) and compound Ab-3 (4.6 g per Kg of the chemically sensitized finished emulsion) were added. The thus-obtained emulsion was designated as Emulsion GM-1. The finished emulsion contains 90 g of silver halide in equivalent to metal silver, and 64 g of gelatin per Kg of the finished emulsion.

Preparation of Green-Sensitive Layer Emulsion GL-1

High silver chloride cubic grains were prepared in the same as the preparation of the Emulsion GH-1, except that an addition rate was changed in the step of simultaneously adding silver nitrate and sodium chloride and mixing them, and between the time when none of the silver nitrate had been added and the time when 50% of the silver nitrate had been added, $K_2[IrCl_6]$ ($9.5\times10^{-8}$ mol per mol of the finished silver halide) was newly and continuously added, and the amount of $K_2[IrCl_5$ (5-methylthiazole)] continuously added between the time when none of the silver nitrate had been added and the time when 50% of the silver nitrate had been added was changed to $3.8\times10^{-7}$ mol per mol of the finished silver halide, and the amount of $K_4[Fe(CN)_6]$ continuously added between the time when 50% of the silver nitrate had been added and the time when 100% of the silver nitrate had been added, was changed to $6.3\times10^{-6}$ mol per mol of the finished silver halide. Further, the amount of the 2% aqueous solution of RNA-F3 manufactured by NIPPON PAPER Chemicals CO., LTD. that was added after completion of addition of the silver nitrate was change to 33.8 cc per mol of the finished silver halide. The addition amount of the sensitizing dye represented by the above-described S-4 was changed to $5.5\times10^{-4}$ mol per mol of silver halide, and the addition amount of the compound represented by the above-described C-4 was changed to $6.5\times10^{-4}$ mol per mol of silver halide. The thus-obtained emulsion grains were mono-dispersed cubic silver chloride grains having a side length of 0.11 μm and variation coefficient of 15.1%. This emulsion was re-dispersed by subjecting the emulsion to a deposition desalting processing in the same manner as the Emulsion GH-1. The halogen composition (%) of the emulsion grains was Cl/Br/I=100/0/0.

To the emulsion thus re-dispersed, a sodium hydroxide aqueous solution was added and the pH value of the emulsion was adjusted to 5.30 at 40° C. Next, the emulsion was chemically sensitized by adding thereto sodium benzenethiosulfonate ($5.9\times10^{-5}$ mol per mol of silver halide), triethylthiourea ($2.4\times10^{-5}$ mol per mol of silver halide) as a sulfur sensitizer and chloroauric acid tetrahydrate ($1.8\times10^{-5}$ mol per mol of silver halide) as a gold sensitizer, and further by ripening them so that chemical sensitization was optimized. Then, a compound represented by represented by the above-described C-6 ($1.1\times10^{-3}$ mol per mol of silver halide), 1-(5-methylureidophenyl)-5-mercaptotetrazole ($1.1\times10^{-3}$ mol per mol of silver halide), potassium bromide ($2.5\times10^{-2}$ mol per mol of silver halide), and a compound represented by the above-described C-7 ($2.4\times10^{-4}$ mol per mol of silver halide) were added to complete chemical sensitization. Finally, compound Ab-1 (0.56 g per Kg of the chemically sensitized finished emulsion) and compound Ab-3 (4.6 g per Kg of the chemically sensitized finished emulsion) were added. The thus-obtained emulsion was designated as Emulsion GL-1. The finished emulsion contains 85 g of silver halide in equivalent to metal silver, and 60 g of gelatin per Kg of the finished emulsion.

Preparation of Dye Solid Fine Particle Dispersion

A methanol wet cake of the following compound (D-1) was weighed in a net amount of 240 g, and 48 g of the following compound (Pm-1) as a dispersion aid was weighed, to which water was added to make the total amount of 4000 g. 1.7 liters of zirconia beads (diameter: 0.5 mm) were charged in "Circulation Sand Grinder Mill (UVM-2) manufactured by IMEX CO., Ltd. The above mixture was pulverized using this mill at discharge rate of 0.5 liter/min and a peripheral speed of 10 m/s for 2 hours. Thereafter, the resultant dispersion was diluted to make a concentration of the compound of 3% by mass, and the compound (Pm-1) represented by the following formula was added to the dispersion in an amount of 3% by mass relative to the dye (this dispersion is designated as a dispersion A). The dispersion had a mean particle size of 0.45 μm.

Further, similarly to the above method, a dispersion containing 5% by mass of the following compound (D-2) was obtained (this dispersion is designated as a dispersion B).

Pm-1

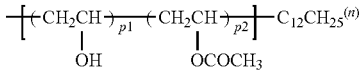

p1 = 88% by mole
p2 = 12% by mole
Polymerization Degree 300

D-1

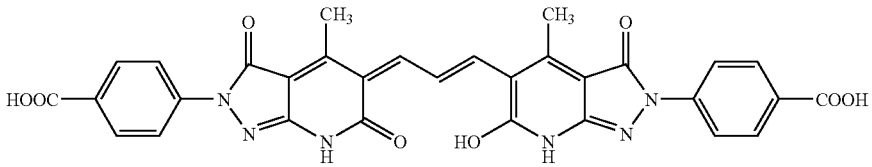

D-2

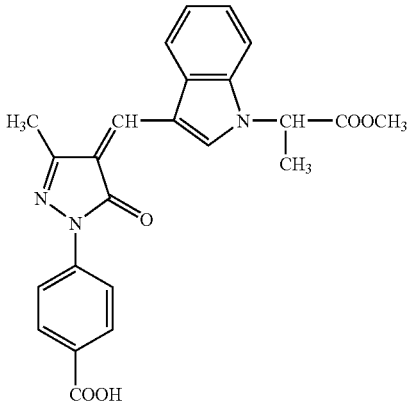

Production of Sample 200

A multilayer color photosensitive material sample 200 was produced by multilayer coating each layer having the below-described composition on a support.

Preparation of Third Layer Coating Liquid

In 29 ml of a solvent (Solv-21), 3 ml of a solvent (Solv-24) and 150 ml of ethyl acetate, 72.2 g of a yellow coupler (ExY-1), 0.4 of an additive (Cpd-44), 0.8 of an additive (Cpd-46), 0.1 of an additive (Cpd-58) and 2.0 g of the following compound (SR-2) were dissolved. The resultant solution was dispersed and emulsified in 1000 g of a 10% gelatin aqueous solution containing 15 ml of a 20% aqueous solution of the following compound (SR-1), thereby preparing an emulsion dispersion Y-1. Meanwhile, the emulsion dispersion Y-1 and the above-described silver chlorobromide emulsions BH-1, BM-1 and BL-1 were mixed and dissolved to prepare a third layer coating liquid having the below-described composition. Further, coating liquids for a first layer to a second layer, and a forth layer to an eighth layer were also prepared in the same manner as in the third layer coating liquid.

SR-1

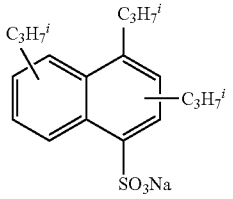

SR-2

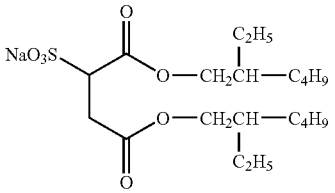

Layer Composition

The composition of each layer is described below. The numbers represent a coating amount (g/m$^2$). The coated amount of silver halide emulsion is a value in terms of coated silver amount. As a gelatin hardener, 1-oxy-3,5-dichloro-s-triazine sodium salt was used.

Layer Composition of Sample 200

Support

The above-described polyethyleneterephthalate film

| First layer (Undercoat layer (light-insensitive hydrophilic colloid layer)) | |
|---|---|
| Gelatin | 0.25 |
| (Cpd-59) | 0.003 |
| **Second layer (Antihalation layer (light-insensitive hydrophilic colloid layer))** | |
| Gelatin | 1.83 |
| The above-described dispersion A (in terms of coated dye amount) | 0.10 |
| The above-described dispersion B (in terms of coated dye amount) | 0.03 |
| **Third layer (Blue-sensitive silver halide emulsion layer)** | |
| A mixture of emulsions BH-1, BM-1 and BL-1(10:15:75 in terms of silver molar ratio) | 0.44 |
| Gelatin | 3.12 |
| Yellow coupler (ExY-1) | 1.33 |

-continued

| | |
|---|---|
| (Cpd-41) | 0.0006 |
| (Cpd-42) | 0.01 |
| (Cpd-44) | 0.007 |
| (Cpd-45) | 0.015 |
| (Cpd-46) | 0.002 |
| (Cpd-54) | 0.08 |
| (Cpd-58) | 0.007 |
| (Cpd-65) | 0.02 |
| (SR-1) | 0.06 |
| (SR-2) | 0.04 |
| Solvent (Solv-21) | 0.53 |
| Solvent (Solv-24) | 0.05 |
| **Forth layer (Anti-color mixing layer)** | |
| Gelatin | 0.74 |
| (Cpd-49) | 0.02 |
| (Cpd-43) | 0.05 |
| (Cpd-53) | 0.006 |
| (Cpd-61) | 0.02 |
| (Cpd-62) | 0.03 |
| (SR-1) | 0.009 |
| Solvent (Solv-21) | 0.12 |
| Solvent (Solv-23) | 0.05 |
| Solvent (Solv-24) | 0.002 |
| **Fifth layer (Red-sensitive silver halide emulsion layer)** | |
| A mixture of emulsions RH-1, RM-1 and RL-1(10:30:60 in terms of silver molar ratio) | 0.35 |
| Gelatin | 2.88 |
| Cyan coupler (Ex C') | 0.83 |
| (Cpd-47) | 0.14 |
| (Cpd-48) | 0.05 |
| (Cpd-50) | 0.03 |
| (Cpd-51) | 0.04 |
| (Cpd-53) | 0.02 |
| (Cpd-57) | 0.02 |
| (Cpd-58) | 0.01 |
| (Cpd-59) | 0.0003 |
| (Cpd-60) | 0.02 |
| (SR-1) | 0.03 |
| (SR-2) | 0.03 |
| Solvent (Solv-21) | 0.50 |
| Solvent (Solv-22) | 0.25 |
| Solvent (Solv-23) | 0.02 |
| **Sixth layer (Anti-color mixing layer)** | |
| Gelatin | 0.57 |
| (Cpd-49) | 0.02 |
| (Cpd-43) | 0.05 |
| (Cpd-53) | 0.005 |
| (Cpd-62) | 0.03 |
| (Cpd-63) | 0.02 |
| (Cpd-64) | 0.002 |
| (SR-1) | 0.007 |
| Solvent (Solv-21) | 0.09 |
| Solvent (Solv-23) | 0.04 |
| Solvent (Solv-24) | 0.002 |
| **Seventh layer (Green-sensitive silver halide emulsion layer)** | |
| A mixture of emulsions GH-1, GM-1 and GL-1(15:30:55 in terms of silver molar ratio) | 0.46 |
| Gelatin | 1.67 |
| Magenta coupler (Ex M') | 0.73 |
| (Cpd-49) | 0.013 |
| (Cpd-52) | 0.001 |
| (SR-1) | 0.02 |
| (SR-2) | 0.02 |
| Solvent (Solv-21) | 0.15 |
| **Eighth layer (Protective layer)** | |
| Gelatin | 0.97 |
| Acrylic resin (mean particle size: 2 μm) | 0.002 |
| (Cpd-55) | 0.005 |
| (Cpd-56) | 0.08 |
| (SR-2) | 0.03 |

The compounds used in these preparations are shown below.
ExY-1
(1)
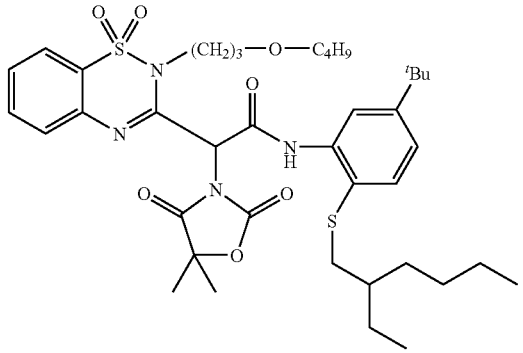
(2)
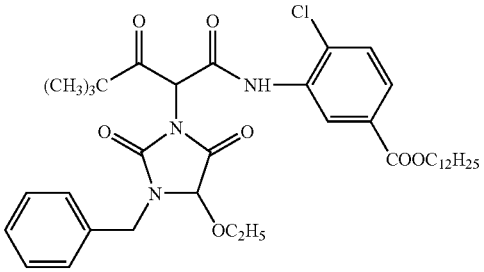
(3)
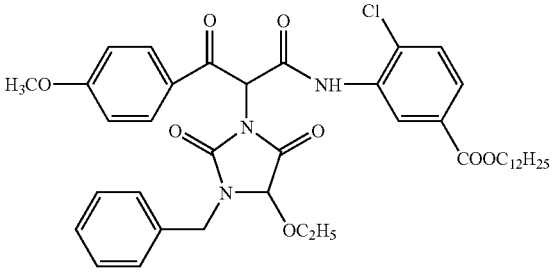
Mixture of (1), (2) and (3) having a molar ratio of 75:5:20
ExY-2
(1)
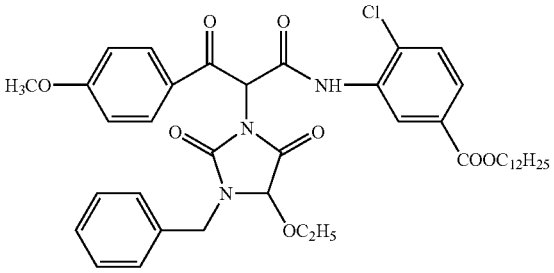
-continued
(2)
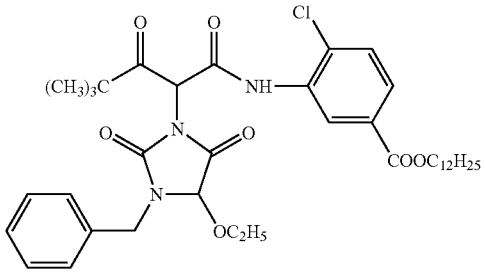
(3)
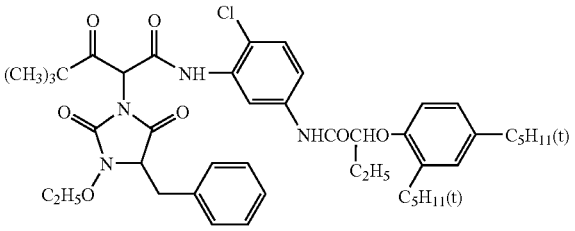
Mixture of (1), (2) and (3) having a molar ratio of 80:10:10
ExC'
(1)
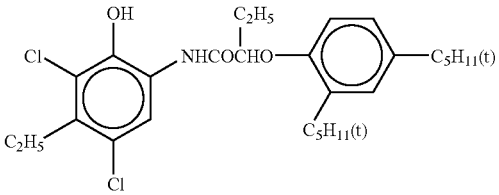
(2)
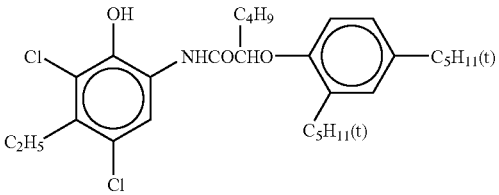
(3)
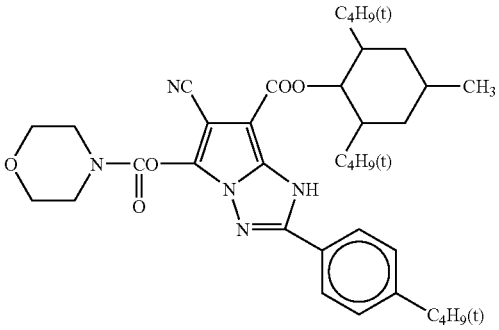

-continued
(4)
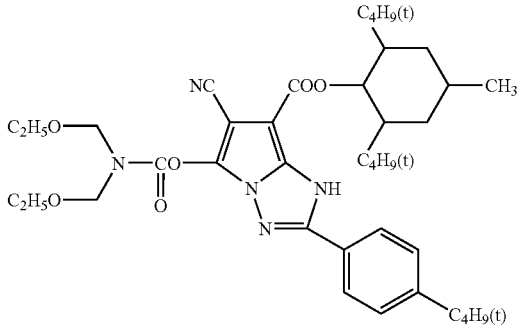
Mixture of (1), (2), (3) and (4) having a molar ratio of 40:40:10:10
ExM′
(1)
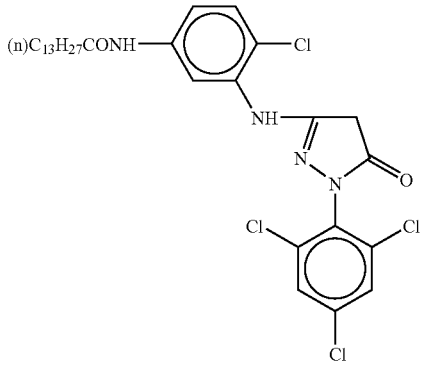
(2)
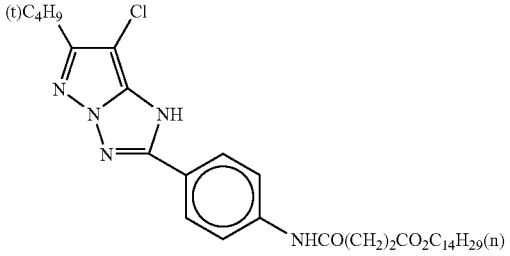
(3)
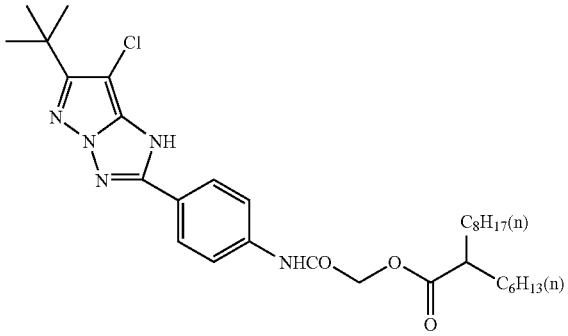
Mixture of (1), (2) and (3) having a molar ratio of 90:5:5
(Cpd-41)
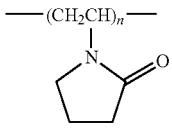
(Cpd-42)
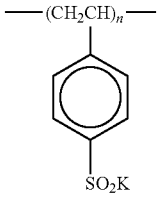
(Cpd-43)
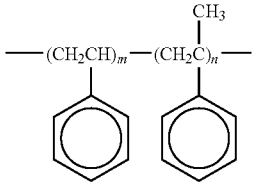
Number average molecular weight 600
m/n = 10/90
(Cpd-44)
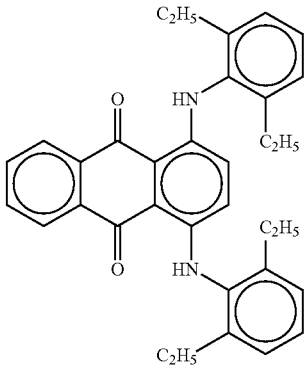
(Cpd-45)
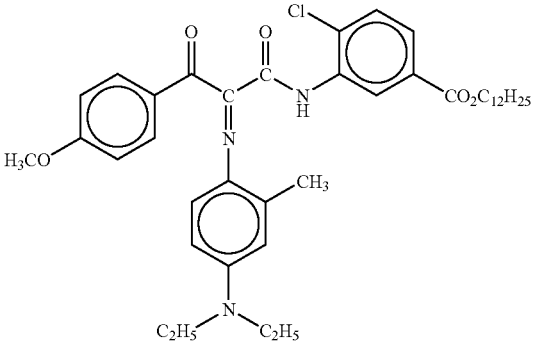

-continued
(Cpd-46)
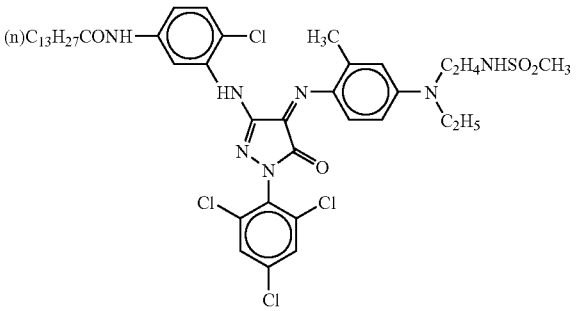
(Cpd-47)
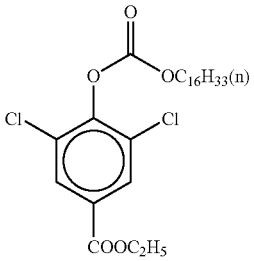
(Cpd-48)
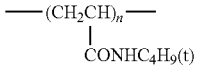
Average molecular weight about 60,000
(Cpd-49)
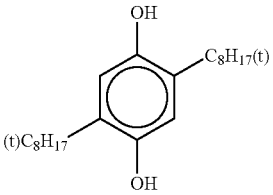
(Cpd-50)
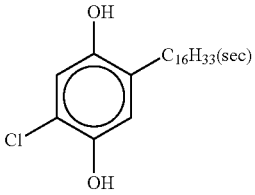
(Cpd-51)
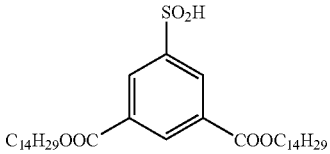
(Cpd-52)
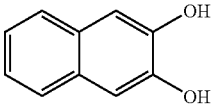
(Cpd-53)
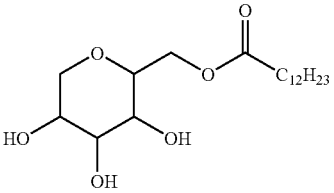
-continued
(Cpd-54)
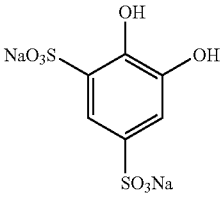
(Cpd-55)
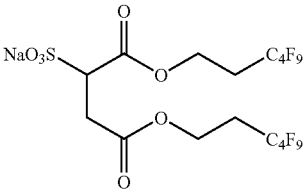
(Cpd-56)
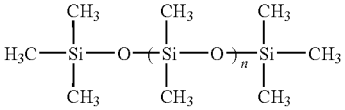
(Cpd-57)
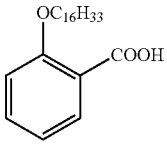
(Cpd-58)
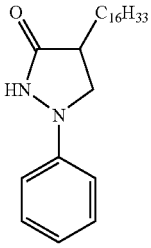
(Cpd-59)
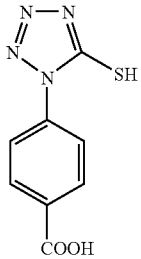
(Cpd-60)
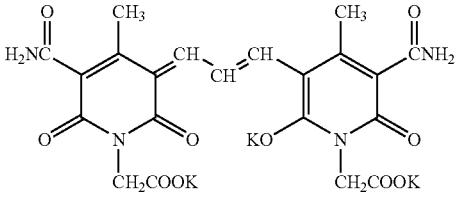

-continued (Cpd-61)

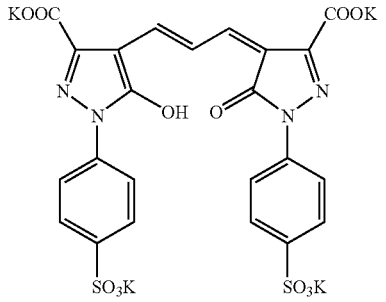

(Cpd-62)

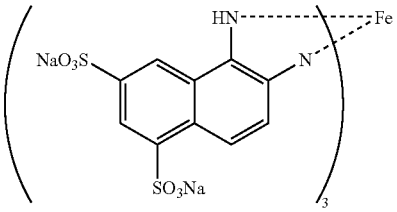

(Cpd-63)

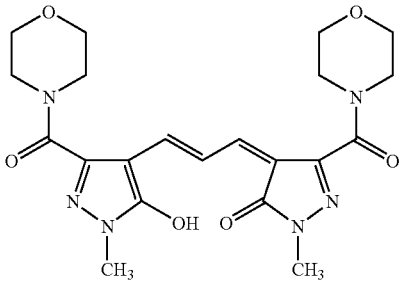

(Cpd-64)

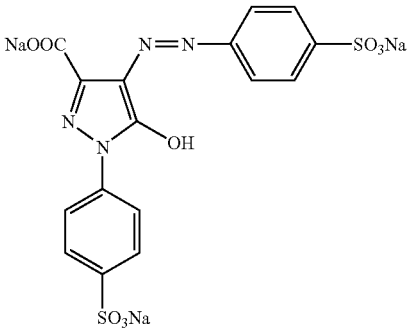

(Cpd-65)

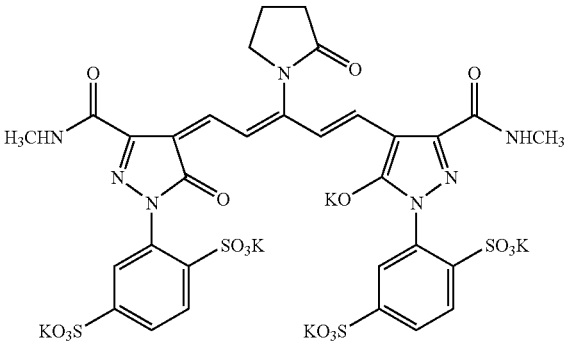

(Solv-21)

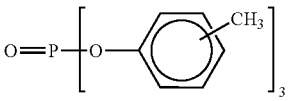

-continued (Solv-22)

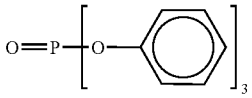

(Solv-23)

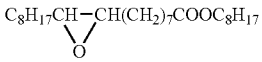

(Solv-24)

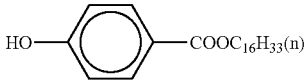

The sample 200 was produced as described above. With respect to the sample 200, the first layer and the second layer correspond to a first interlayer, and in a similar way the third layer to a blue-sensitive silver halide emulsion layer; the forth layer to a second interlayer; the fifth layer to a red-sensitive silver halide emulsion layer; the sixth layer to a third interlayer; the seventh layer to a green-sensitive silver halide emulsion layer; and the eighth layer to a protective layer, respectively.

The iron powder contamination that has been aimed at reduction in a second aspect of the invention incidentally occurs during production. For this reason, it is necessary to build a mandatory experimental system for simulating the iron powder contamination. For this purpose, a sample 201 was produced by adding finely ground iron powder in a coating liquid for a first layer of the sample 200 so as to be a coating amount of 0.0010 g/m$^2$.

Production of Samples 202 to 220

Samples 202 to 215 were produced by adding EDTA.2Na or NTA.3Na as a chelating agent to a layer constituting the sample 201 as shown in Table 4. Further, sample 216 was produced by equimolar substitution of a dye-forming coupler (ExY-2) disclosed and known in Example of JP-A No. 2007-199703 for the dye-forming couplers used in the third layer of sample 201. Further, samples 217 to 220 were produced by adding EDTA.2Na as a chelating agent to the layer of the sample 216 shown in Table 4.

TABLE 4

| Sample No. | Kind of Chelating Agent | Amount of Chelating Agent (mol/m$^2$) | Layer containing Chelating Agent | Dye-forming Couplers in Third layer |
|---|---|---|---|---|
| 200 | — | — | — | ExY-1 |
| 201 | — | — | — | ExY-1 |
| 202 | EDTA•2Na | $1.0 \times 10^{-4}$ | First layer | ExY-1 |
| 203 | EDTA•2Na | $3.0 \times 10^{-4}$ | First layer | ExY-1 |
| 204 | EDTA•2Na | $1.0 \times 10^{-3}$ | First layer | ExY-1 |
| 205 | EDTA•2Na | $3.0 \times 10^{-3}$ | First layer | ExY-1 |
| 206 | EDTA•2Na | $1.0 \times 10^{-3}$ | Second layer | ExY-1 |
| 207 | EDTA•2Na | $1.0 \times 10^{-3}$ | Third layer | ExY-1 |
| 208 | EDTA•2Na | $1.0 \times 10^{-3}$ | Forth layer | ExY-1 |
| 209 | NTA•3 Na | $1.0 \times 10^{-4}$ | First layer | ExY-1 |
| 210 | NTA•3 Na | $3.0 \times 10^{-4}$ | First layer | ExY-1 |
| 211 | NTA•3 Na | $1.0 \times 10^{-3}$ | First layer | ExY-1 |
| 212 | NTA•3 Na | $3.0 \times 10^{-3}$ | First layer | ExY-1 |
| 213 | NTA•3 Na | $1.0 \times 10^{-3}$ | Second layer | ExY-1 |
| 214 | NTA•3 Na | $1.0 \times 10^{-3}$ | Third layer | ExY-1 |
| 215 | NTA•3 Na | $1.0 \times 10^{-3}$ | Forth layer | ExY-1 |
| 216 | — | — | — | ExY-2 |
| 217 | EDTA•2Na | $1.0 \times 10^{-4}$ | First layer | ExY-2 |
| 218 | EDTA•2Na | $3.0 \times 10^{-4}$ | First layer | ExY-2 |
| 219 | EDTA•2Na | $1.0 \times 10^{-3}$ | First layer | ExY-2 |
| 220 | EDTA•2Na | $3.0 \times 10^{-3}$ | First layer | ExY-2 |

Preparation of Samples for Evaluation

The samples 200 to 220 thus prepared were stored for 30 days from immediately after completion of coating under the conditions of 25° C. and 60% RH. Thereafter, for use in evaluation, a test specimen was taken from each sample.

Evaluation of Photographic Properties

Sensitometry was carried out according to a conventional method. An exposure for sensitometry was applied to the samples for 1/100 of a second through an optical wedge continuously changing the exposure amount using a sensitometer (MODEL FW, produced by FUJIFILM Corporation, color temperature of light source: 3,200 K). During exposure, color temperature was controlled using a color filter so that a yellow density of 1.0±0.05 and a cyan density of 1.0±0.05 were each obtained at an exposure amount necessary to obtain a magenta density of 1.0. Exposure amounts suitable for evaluation ranging from an unexposed portion to a maximum density were set. The exposed samples were subjected to the development processing described below after 30 minutes had elapsed since the exposure.

With respect to the development processing, a processing process was prepared in which a first fixing solution and a washing bath subsequent thereto, and sound development steps were omitted from the below-described ECP-2D process disclosed by Eastman Kodak Corporation as a standard processing process for a movie color positive film. Using the sample 200 to which exposure was applied in an amount sufficient to give a standard gray density, a continuous processing (running) was carried out according to the above-described processing process until a replenisher volume of the color developing bath became twice a tank volume.

ECP-2D Process<Steps>

TABLE 5

| Steps | Processing Temperature (° C.) | Processing Time (sec.) | Replenisher Volume(*) (ml) |
|---|---|---|---|
| 1. Development | 6.7 ± 0.1 | 180 | 690 |
| 2. Stop | 27 ± 1 | 40 | 770 |
| 3. Washing | 27 ± 3 | 40 | 1200 |
| 4. First Fixing | 27 ± 1 | 40 | 200 |
| 5. Washing | 27 ± 3 | 40 | 1200 |
| 6. Bleaching | 27 ± 1 | 60 | 400 |
| 7. Washing | 27 ± 3 | 40 | 1200 |
| 8. Sound Development | (***) | 10 to 20 | -(coating) |
| 9. Washing | 27 ± 3 | 1 to 2 | -(spray) |
| 10. Second Fixing | 27 ± 1 | 40 | 200 |
| 11. Washing | 27 ± 3 | 60 | 1200 |
| 12. Rinsing | 27 ± 3 | 10 to 20 | 400 |
| 13. Drying (**) | | | |

(*)Addion amount of replenisher per processing area of 35 mm × 30.48 m () 57° C. (15 to 25% RH) 3 to 5 minutes (*) Room Temperature Composition of Processing Solution The composition of each of the processing solutions used in this Example is shown in the following Table 6. The amount of each chemical indicates a value per liter of each processing solution.

TABLE 6

| Name of Process Steps | Name of Processing Solution | Name of Chemicals | Tank Solution | Re-plenisher |
|---|---|---|---|---|
| Developer | Kodak (SD-50) | Anti-Calcium No. 4 (trade name) | 1.0 ml | 1.4 ml |
| | | Sodium sulfite | 4.35 g | 4.50 g |
| | | FCD-02 (trade name) | 2.95 g | 6.00 g |
| | | Sodium carbonate | 17.1 g | 18.0 g |
| | | Sodium bromide | 1.72 g | 1.60 g |
| | | Sodium hydroxide | — | 0.6 g |
| | | Sulfuric acid (7N) | 0.62 ml | — |
| Stop | Kodak (SB-14) | Sulfuric acid (7N) | 50 ml | 50 ml |
| Fixer | Kodak (F-35d) common to 1st and 2nd fixers | Ammonium thiosulfate (58%) | 100 ml | 170 ml |
| | | Sodium sulfite | 2.5 g | 16.0 g |
| | | Sodium hydrogen sulfite | 10.3 g | 5.8 g |
| | | Potassium iodide | 0.5 g | 0.7 g |
| Bleach | | Proxel GXL (Avecia, Inc.) | 0.07 ml | 0.07 ml |
| | | Potassium hydroxide | — | 84 ml |
| | | Chelating Agent No. 1 (Kodak) | 54 g | 60 g |
| | | Potassium bromide | 92 g | 101 g |
| | | Sulfuric acid (7N) | 13.5 ml | 15.0 ml |
| Sound Track Developer | Kodak (SD-43b) | Natrosol 250 HR | 2.0 g | |
| | | Sodium hydroxide | 80 g | |
| | | Hexylglycol | 2.0 ml | |
| | | Sodium sulfite | 60 g | |
| | | Hydroquinone | 60 g | |
| | | Ethylene diamine (98%) | 13 ml | |
| Rinse | Kodak (FR-2) | Kodak Stabilizer Additive | 0.14 ml | 0.17 ml |
| | | Dearcide 702 (trade name) | 0.7 ml | 0.7 ml |

In the above table, FCD-02 used in the development step is a developing agent, and Dearcide 702 used in the rinse step is a fungicide.

After development processing, test specimens were subjected to a status-A densitometric measurement to obtain characteristic curves (D-log E curves).

From the characteristic curve, a minimum density (Dmin) and a maximum density (Dmax) were read. The results of yellow density are shown in Table 7. The Dmin is a character of the smaller, the better, while the D max is a character of the larger, the better.

Evaluation of Spot Fog

A test specimen was subjected to the above-described development processing while remaining in the unexposed condition. Thereafter, the number of spot fog was measured. The thus-obtained numbers of spot fog expressed as a relative value, assuming that the measured number of spot fog generated in sample 201 is 100, are shown in the following Table 7. The smaller number of spot fog, the better.

Evaluation of Photographic Properties after Storage

Each test specimen was left for 3 days under the conditions of 60° C. and 30% RH, and then as a short term compulsory evaluation of the storage test, sensitometry was carried out in the same manner as the evaluation of the above-described photographic properties to obtain a minimum density (Dmin). A change of Dmin arising from storage for 3 days under the conditions of 60° C. and 30% RH was measured relative to the evaluation of the above-described photographic properties. The results thus obtained are expressed as Δ Dmin.

The Δ Dmin is a character of the smaller, the better. 0 is most desirable.

TABLE 7

| Sample No. | Photographic Properties Dmin (Y) | Dmax (Y) | Δ Dmin* | Number of spot fog (Relative value) | Note** |
|---|---|---|---|---|---|
| 200 | 0.17 | 3.90 | 0.00 | 0 | Comp. Ex. |
| 201 | 0.17 | 3.90 | 0.00 | 100 | Comp. Ex. |
| 202 | 0.17 | 3.90 | 0.00 | 5 | Invention |
| 203 | 0.17 | 3.90 | 0.00 | 0 | Invention |
| 204 | 0.17 | 3.90 | 0.00 | 0 | Invention |
| 205 | 0.20 | 3.90 | 0.05 | 0 | Invention |
| 206 | 0.17 | 3.90 | 0.01 | 0 | Invention |
| 207 | 0.33 | 3.90 | 0.16 | 40 | Comp. Ex. |
| 208 | 0.17 | 3.90 | 0.00 | 75 | Comp. Ex. |
| 209 | 0.17 | 3.90 | 0.00 | 25 | Invention |
| 210 | 0.17 | 3.90 | 0.00 | 15 | Invention |
| 211 | 0.17 | 3.90 | 0.00 | 10 | Invention |
| 212 | 0.18 | 3.90 | 0.02 | 5 | Invention |
| 213 | 0.17 | 3.90 | 0.00 | 10 | Invention |
| 214 | 0.25 | 3.90 | 0.07 | 60 | Comp. Ex. |
| 215 | 0.17 | 3.90 | 0.00 | 95 | Comp. Ex. |
| 216 | 0.16 | 3.30 | 0.00 | 80 | Comp. Ex. |
| 217 | 0.16 | 3.30 | 0.00 | 20 | Invention |
| 218 | 0.16 | 3.30 | 0.00 | 5 | Invention |
| 219 | 0.16 | 3.30 | 0.00 | 0 | Invention |
| 220 | 0.18 | 3.30 | 0.04 | 0 | Invention |

* Photographic properties after storage are expressed in terms of Δ Dmin.
** Comp. Ex. is abbreviation of Comparison Example.

From the results shown in Table 7, it is understood that a spot fog defect arising from an iron powder is reduced in the silver halide photosensitive materials according to the second aspect of the invention, and EDTA.2Na exhibits particularly conspicuous effect on the reduction of spot fog defect. Further, from comparison between samples 202 to 205 and samples 217 to 220, it is understood that the samples 202 to 205 each containing a yellow dye-forming coupler encompassed by Formula (IV) are superior to the samples 217 to 220 each containing a hitherto-known yellow dye-forming coupler in terms of coloring properties (Dmax). As is apparent from comparison between sample 201 and sample 216, the yellow dye-forming coupler encompassed by Formula (IV) has a drawback in terms of spot fog defect. However, in samples 202 to 205, very favorable results from a comprehensive viewpoint were obtained because these samples achieved more substantially effects of the invention. The results of samples 205, 212 and 220 each show beginning of increase in both Dmin of photographic properties and Δ Dmin of photographic properties after storage, and suggest that if a chelating agent is added in excessive quantities, defect of photographic properties may occur.

All publications, patent applications, and technical standards mentioned in this specification are herein incorporated by reference to the same extent as if each individual publication, patent applications, or technical standards was specifically and individually indicated to be incorporated by reference.

What is claimed is:

1. A silver halide photographic photosensitive material having, in the following order, a support, a red-sensitive silver halide emulsion layer, a first interlayer, a green-sensitive silver halide emulsion layer, a second interlayer, and a blue-sensitive silver halide emulsion layer, wherein the first interlayer comprises a chelating agent.

2. The silver halide photographic photosensitive material of claim 1, wherein the chelating agent is a compound represented by the following Formula (I):

Formula (I)

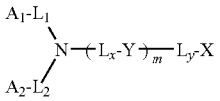

wherein, in Formula (I), $L_x$ and $L_y$ each independently represent an alkylene group or a substituted alkylene group; Y represents —O—, or a group represented by the following Formula (II):

Formula (II)

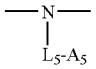

m represents an integer of 0 or 1; X represents a carboxyl group or an alkali metal salt thereof, a phosphono group or an alkali metal salt thereof, a sulfo group or an alkali metal salt thereof, a hydroxyl group or a group represented by the following Formula (III):

Formula (III)

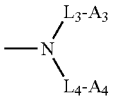

$A_1$, $A_2$, $A_3$, $A_4$ and $A_5$ each independently represent a carboxyl group or an alkali metal salt thereof, a phosphono group or an alkali metal salt thereof, a sulfo group or an alkali metal salt thereof, or a hydroxyl group; and $L_1$, $L_2$, $L_3$, $L_4$ and $L_5$ each independently represent an alkylene group.

3. The silver halide photographic photosensitive material of claim 1, wherein the chelating agent is EDTA (ethylenediaminetetraacetic acid), a sodium salt of EDTA, NTA (nitrilotriacetic acid), or a sodium salt of NTA.

4. The silver halide photographic photosensitive material of claim 1, wherein the content of the chelating agent is from $1.0\times10^{-8}$ mol/m$^2$ to $2.0\times10^{-3}$ mol/m$^2$.

5. The silver halide photographic photosensitive material of claim 1, wherein the content of the chelating agent is from 0.0001 g/m$^2$ to 0.6 g/m$^2$.

6. A method of producing a silver halide photographic photosensitive material having, in the following order, a long film base, a red-sensitive silver halide emulsion layer, a first interlayer, a green-sensitive silver halide emulsion layer, a second interlayer, and a blue-sensitive silver halide emulsion layer, the method comprising:

coating at one time or separately divided into plural times a coating liquid for the red-sensitive silver halide emulsion layer, a coating liquid for the first interlayer, a coating liquid for the green-sensitive silver halide emulsion layer, a coating liquid for the second interlayer, and a coating liquid for the blue-sensitive silver halide emulsion layer, setting the coating liquids and then drying the coating liquids, wherein the first interlayer contains a chelating agent.

* * * * *